US005222379A

United States Patent [19]

Rikiishi et al.

[11] Patent Number: 5,222,379

[45] Date of Patent: Jun. 29, 1993

[54] CIRCULAR KNITTING MACHINE FOR KNITTING BODY SUITS AND THE LIKE

[75] Inventors: Tsutomu Rikiishi; Hidemasa Sakamoto; Shinji Yamada, all of Bunsui, Japan

[73] Assignee: Nagata Seiki Kabushiki Kaisha, Tokyo, Japan

[21] Appl. No.: 779,001

[22] PCT Filed: Mar. 15, 1991

[86] PCT No.: PCT/JP91/00360

§ 371 Date: Nov. 12, 1991

§ 102(e) Date: Nov. 12, 1991

[87] PCT Pub. No.: WO91/14033

PCT Pub. Date: Sep. 19, 1991

[30] Foreign Application Priority Data

Mar. 15, 1990 [JP] Japan ..... 2-64817
Mar. 15, 1990 [JP] Japan ..... 2-64818

[51] Int. Cl.[5] ..... D04B 15/32; D04B 15/82

[52] U.S. Cl. ..... 66/30; 66/232

[58] Field of Search ..... 66/30, 54, 57, 178 R, 66/183, 232

[56] References Cited

U.S. PATENT DOCUMENTS 2,474,894 7/1949 Gottschalck ..... 66/183
2,685,786 8/1954 Stack ..... 66/178 R
3,299,673 1/1967 Noll ..... 66/57
3,310,962 3/1967 Mahler et al. ..... 66/57 X
3,413,824 12/1968 Kuney ..... 66/54
4,712,390 12/1987 Lonati ..... 66/54
4,879,884 11/1989 Bertagnoli ..... 66/54 X
4,879,885 11/1989 Kühn ..... 66/54
4,934,161 6/1990 Güell ..... 66/54

*Primary Examiner*—Clifford D. Crowder
*Assistant Examiner*—John J. Calvert
*Attorney, Agent, or Firm*—Ladas & Parry

[57] ABSTRACT

In order to enable knitting continuously an elastic waist part or a locally bulging breast part (C) of a knit apparel such as a body suit, brassiere, petticoat, or panties over the entire structure thereof, the stitching cams (36) and cushion cams (37) of each stitch density adjustment device (35) of a circular knitting machine are caused by signals from a stitch density adjustment control device (E) to undergo up-and-down movement relative to a second guard cam (30) independently in each knitting section (I, II, III, . . .) or simultaneously altogether with respect to all knitting sections by way of an operating ring (38). Also, for knitting various patterns, the stitching cams (36) together with other cams are caused to advance and retract in the radial direction of the knitting cylinder (2). Furthermore, for a partial pile knit part (h), a movable lowering cam (136) on the upstream side of an auxiliary stitching cam (134) is caused to retract thereby to open a knitting needle butt operation passageway above the auxiliary stitching cam (134).

9 Claims, 19 Drawing Sheets

CIRCULAR KNITTING MACHINE FOR KNITTING BODY SUITS AND THE LIKE

TECHNICAL FIELD

The present invention relates to a circular knitting machine for knitting knitware such as body suits, brassieres, petticoats, and panties.

BACKGROUND ART

Heretofore, in knitware such as body suits, brassieres, petticoats, and panties, patterning by jacquard pattern and press dyeing has been carried out in many cases by patterning of each body part. Such knitware has been produced by knitting knitted fabrics of great width with knitting machines having needle cylinders of large diameter, and cutting these fabrics according to the shapes of the knitware such as body suits, brassieres, petticoats, and panties. This has been done by cutting the shapes of the parts, such as the neck part, sleeve part, body part, leg-opening parts, and crotch parts, of each article, and sewing together the pieces of knitted fabric thus cut.

Consequently, because the parts, such as the neck part, sleeve part, body part, the leg opening parts, and the crotch parts, are fabricated by sewing from knitted fabric, the article as is composed as a whole of the same knitting texture the body parts.

Although the patterns produced by jacquard knitting and by press dyeing are the principal patterns for body parts, in practice there has been use together of two patterns of different character, such as composite patterns of spiral pattern having transparency, motif pattern of embroidery knitting, and composite pattern of tuck and knit miss, to produce a variegated design and enhance the fashionability and value of the product.

However, in the above described method of knitting body suits and the like, a process step of sewing together two knitted fabric pieces of the front and back at their two lateral sides is necessary in all cases, and this step is accompanied by the following problems.

(a). Much labor and time must be expended to sew the pieces together, and quantity (mass) production and reduction of labor are difficult.

(b). The front and back knitted fabric pieces are first made and are subsequently sewn together. Cutting, contracting, etc., of the knitted fabric gives rise to deviations in dimensions between the two sides, whereby pattern mismatching and/or shape mismatching occur after the parts are sewn together, and improving the product quality is difficult.

(c). In a body suit having a pattern over its entire surface, mismatching of the pattern occurs at the sewn seam part because of the sewing together, whereby matching requires skilled labor.

(d). Furthermore, as described hereinbefore, the various parts, such as the neck part, the sleeve part, the body part, the leg opening part, and the crotch part, are cut according to their respective sizes and body shapes and then sewn together. For this reason, the fabrication process becomes complicated.

(e). Another problem arises from the fact that the bust part and the crotch part are knitted in the same manner as the knitted texture of the entire body part. This does not provide for local moisture absorption and temperature insulation in a body suit or the like for women. Other knitted fabrics must be sewn together to compensate for this.

(f). For mock pile knitting (for knitting articles such as this kind of body suit, brassiere, petticoat, and panties), a machine in which pile sinkers of complicated form and a cam control device for controlling this have heretofore been proposed. However the construction is complicated, and assembly, adjustments, maintenance, and inspection are difficult.

The present invention has been made in view of the above described circumstances and has as an object thereof, in the fabrication of articles such as body suits, brassieres, petticoats, and panties, to enable knitting continuously over the entire structure of an article such as a body suit of variegated design without process steps of sewing together two pieces for the front and back along their two lateral sides; to enable garment length knitting of the neck part, sleeve part, body part, leg opening part, thigh part, etc., of a body suit or the like without depending on pile sinkers of complicated shape or a cam control device for controlling this; and, moreover, to enable stitch density adjustment while controlling feeding continuously or intermittently by ground yarn and elastic yarn singly or in composite state, by means of stitch density adjustment devices or yarn feeding devices, and to enable pile or mop pile knitting in a partial localized manner.

DISCLOSURE OF THE INVENTION

The present invention provides a circular knitting machine for knitting body suits and the like, comprising knitting cylinder means mounted in a freely revolvable manner on a machine frame, patterning means and a knitting control cam unit provided in each of knitting sections arranged around the knitting cylinder means, yarn feeding means provided above each knitting control cam unit, and a dial mechanism provided above the knitting cylinder means, each of said knitting control cam units having a first guard cam on an upstream side thereof, a second guard cam on a downstream side thereof, a set of control cams provided below the first guard cam to form an operation passageway for butts of knitting needles, another set of control cams provided below the second guard cam to form an operation passageway for the butts of the knitting needles, and a fitting jack cam and a lowering jack cam provided in each of said knitting sections for guiding jacks, said circular knitting machine further comprising: said other set of control cams including a stitching cam and a cushion cam therebelow constituting a part of a stitch density adjusting device; means for advancing and retracting each stitching cam of all knitting sections relative to the knitting cylinder between an operative position and an inoperative position; first means for actuating in up-and-down movement the stitching cam and the cushion cam of each knitting section relative to the second guard cam regardless of the other knitting sections thereby to carry out stitch density adjustment; and second means for actuating all together and simultaneously in up-and-down movement the stitching cams and the cushion cams of all knitting sections relative to the associated second guard cam thereby to carry out stitch density adjustment.

According to this invention, when knitting a body suit or the like, the patterning means and the knitting control cam unit are controlled in accordance with signals from a knitting control device together with the revolution of the knitting cylinder device, and a part of the control cams of the patterning means and the knitting control cam unit are controlled in advancing and retracting in the radial direction of the knitting cylinder means. Furthermore, the stitch cams of the stitch density adjustment means are controlled in advancing and retracting in the radial direction of the knitting cylinder means for each knitting section or all together with respect to all knitting sections. By these provisions, it becomes possible, without process steps of sewing together along opposite lateral sides two knitted fabric pieces of the front and back, to knit a continuous pattern over the entire surface of a body suit or the like according to a variegated design by using together two patterns of different character. Also, it is possible, without relying on pile sinkers of complicated shapes and cam control devices for controlling the same, to carry out garment length knitting of parts of a body suit or the like such as the neck part, sleeve part, body part, leg opening parts, and crotch parts and knitting of knitting textures differing locally. Furthermore, it is possible, by means of the stitch density adjusting means or yarn feeding means, to control continuously or intermittently by feeding the ground yarn and an elastic yarn singly or in combination, adjusting the stitch density at the same time, and to knit a product such as a body suit of complex form.

BEST MODES FOR CARRYING OUT THE INVENTION

Figure 1:
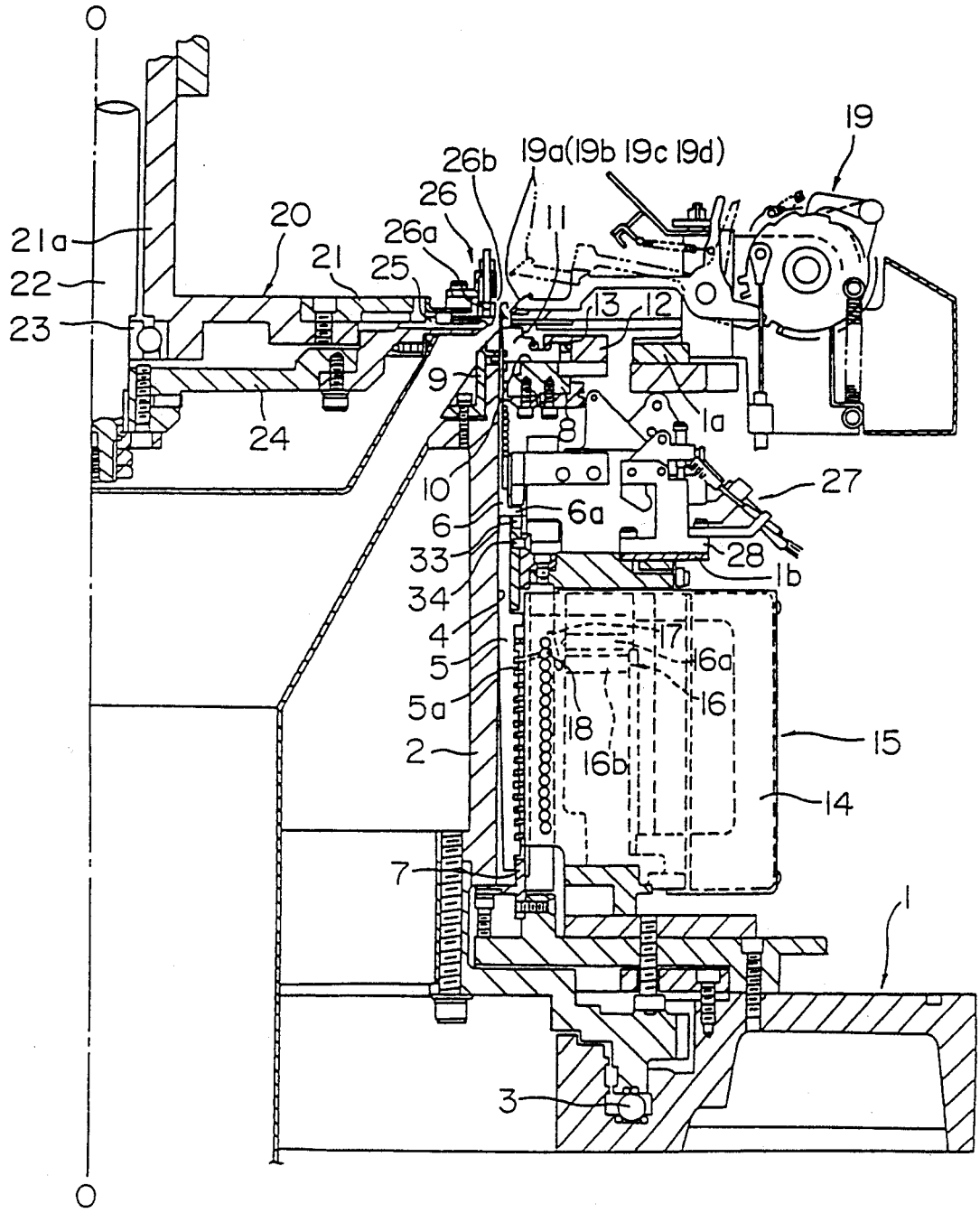
FIG. 1 is a vertical section showing half of the principal parts of a circular knitting machine for knitting body suits, etc., of the present invention.

The present invention will hereinunder be described with respect to embodiments illustrated in the drawings.

1. Knitting cylinder assembly

Figure 2:
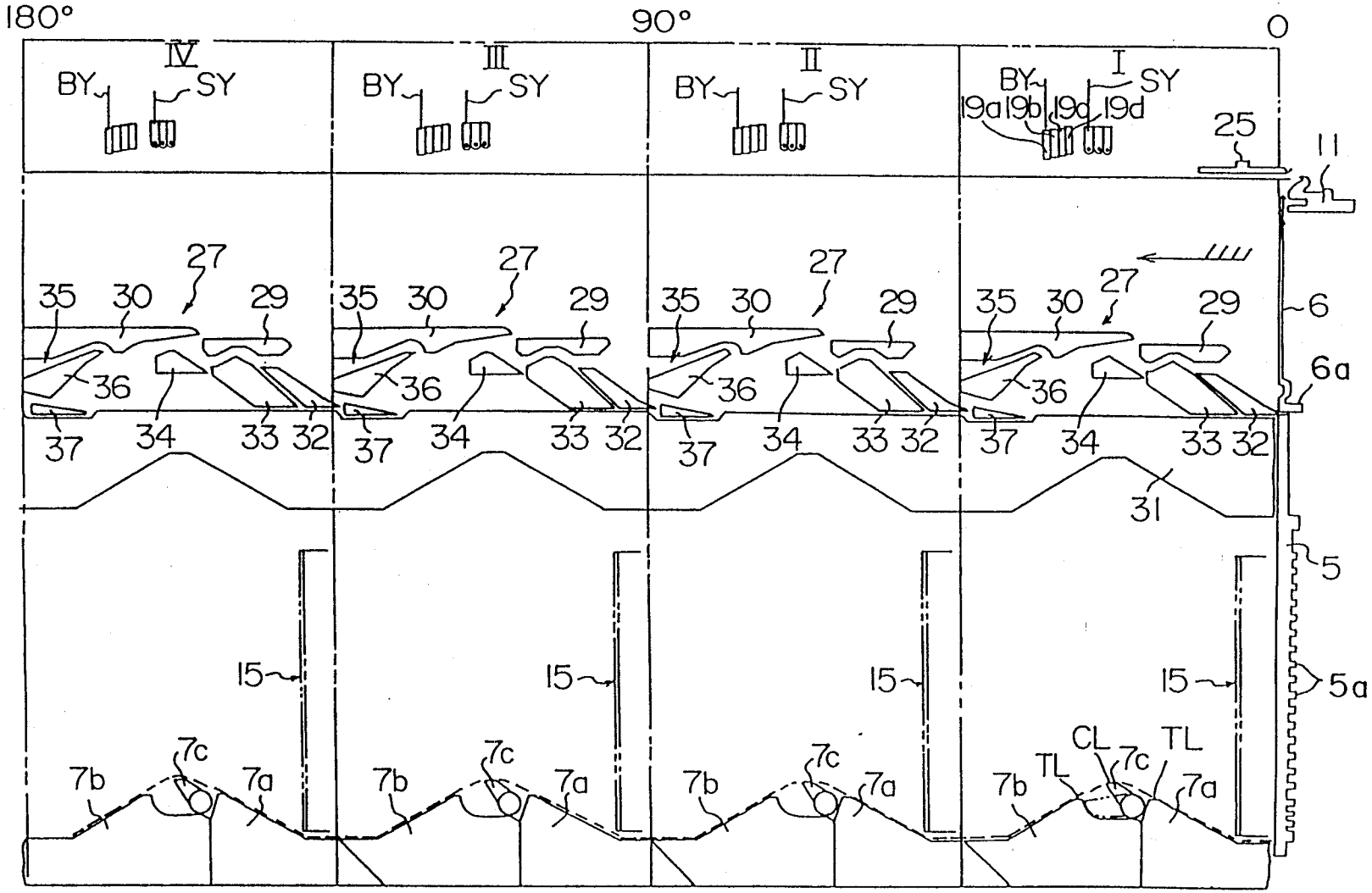
FIG. 2 is a development showing a patterning device and a knitting control cam unit installed in each of a plurality of knitting sections of the circular knitting machine of the invention.

Referring to FIG. 1, reference numeral 1 designates a machine frame constituting an integral structure with a table. On this machine frame 1, a knitting cylinder 2 is revolvable, supported by way of a bearing 3. Around the outer periphery of the knitting cylinder 2, a large number of needle grooves 4 are formed in the axial direction, that is, in the up-and-down direction. In each needle groove 4, a jack 5 and a knitting needle 6 of known type are provided in a freely slidable state in the up-and-down direction. In each of a plurality (8 in this embodiment) of knitting sections provided around the outer periphery of the machine frame 1 in a revolving path at the lower part of the jacks 5, there are provided jack cams 7 each comprising a raising jack cam 7*a* and a lowering jack cam 7*b* of hill-and-valley form as shown in FIGS. 1 and 2 so as to raise together the jacks 5 or the knitting needles 6. As is known, the jacks 5 have butts 5*a*, and the knitting needles 6 have butts 6*a*. Furthermore, between each raising jack cam 7*a* and its respective lowering jack cam 7*b*, a clearing cam 7*c* is provided as shown in FIG. 2 in a manner to freely swing upward or downward so as to raise a jack 5 or a knitting needle 6 from a tuck level TL to a clearing level CL. This clearing cam 7*c* is actuated in its upward and downward swinging movement through a control cable (not shown) in response to a command signal from a patterning control circuit (also not shown) of a patterning device 15 described hereinafter.

Furthermore, as shown in FIG. 1, a sinker bed 8, a top ring 9, and other known parts are mounted on the upper part of the knitting cylinder 2. On the sinker bed 8, a multiple number of sinker grooves 10 are formed radially with respect to the axis of the knitting cylinder 2. In each sinker groove 10 is fitted a pile sinker 11 for knitting fine stitches. These pile sinkers 11 are so provided that they can be moved in sliding motion in the radial direction with respect to the axis of the knitting cylinder 2 by a sinker cam 13 of a sinker cap 12 provided on an upper table 1*a*, which is integral with the machine frame 1.

2. Patterning device

Referring to FIG. 1, in each of the plural number (for example, 8) of knitting sections of the machine frame disposed on the outer side of the jacks 5, a protective frame 14 of box shape is mounted. In each protective frame 14, a patterning device 15 is provided.

Each patterning device 15 comprises a plurality of needle selectors 16, such as piezoelectric needle selectors, each having a pair of upper and lower piezoelectric elements 16*a* and 16*b*. At the extremity of each of the piezoelectric elements 16*a* and 16*b* of each needle selector 16, a needle selecting lever (actuating member) 17 of T shape is pivotally supported by a pivot shaft 18 so as to be capable of pushing the butts 5*a* of the aforedescribed jacks 5. Furthermore, the piezoelectric elements 16*a* and 16*b* of the needle selector 16 operate alternately in response to command signals from a patterning needle selection control circuit to actuate the needle selecting lever 17. The butts 5*a* of the jacks 5 are thereby pushed and carry out a needle selecting operation.

3. Yarn feeding devices

Referring to FIG. 1, on the upper table 1*a* fixed to the machine frame 1 in each of the knitting sections, a yarn feeding device 19 is disposed above the periphery of the knitting cylinder 2. As shown in FIG. 2, through the yarn paths 19*a*, 19*b*, 19*c*, 19*d*, . . . of each yarn feeding device 19, are passed for example, 4 strands of ground yarn BY for knitting plain knitted fabrics, for example, and, for example, 3 strands of spiral pattern forming yarn SY for knitting pile knitted fabrics.

4. Dial mechanism

Referring again to FIG. 1, at the upper part of the centerline o-o of the knitting cylinder 2, a dial member 21 of a dial mechanism 20 is coaxially provided. This dial member 21 has a tubular shaft 21*a*, in the interior of which a revolving spindle or shaft 22 is supported by a bearing 23 so as to revolve in synchronism with the revolution of the knitting cylinder 2. Furthermore, to this revolving shaft 22 is fixed a revolving disk 24 extending horizontally to the upper part of the outer periphery of the knitting cylinder 2. On the radially outward end part of this revolving disk 24 is mounted a known transfer jack 25 for make-up knitting. In addition, immediately above this transfer jack 25, a cutter device 26 comprising a fixed cutter 26*a* and a movable circular cutter 26*b* is provided on the dial member 21 and the revolving disk 24. This cutter device 26 is provided for cutting off yarn ends.

5. Knitting control cam units

Referring to FIG. 1, above each patterning device 15 is provided an annular intermediate table 1*b* integrally fixed to the machine frame 1. On these intermediate tables 16 are mounted knitting control cam units 27 of the same number as the patterning devices 15 and the yarn feeding devices 19 of the plurality of knitting sections (8 knitting sections I to VIII).

Figure 11:
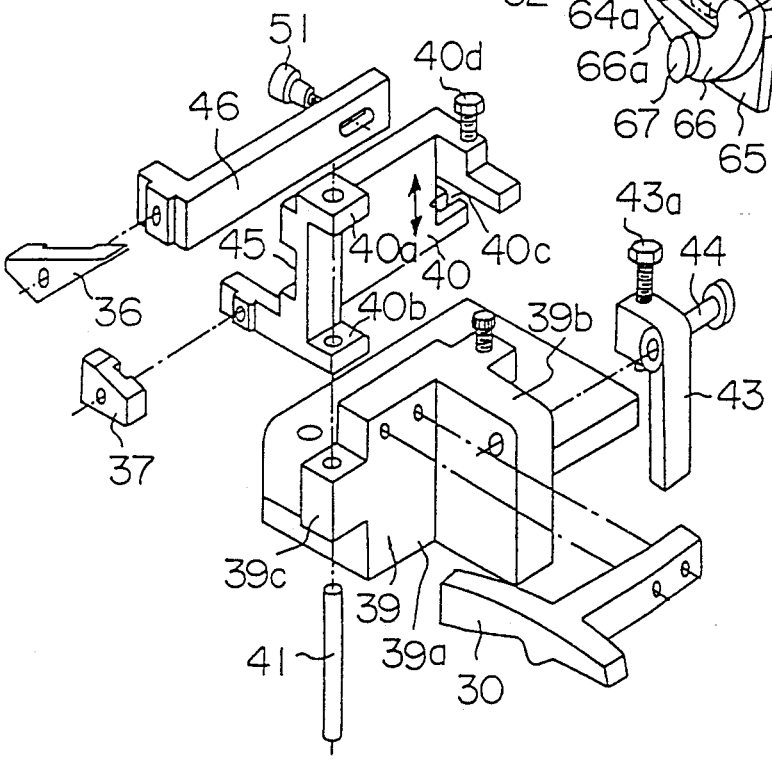
FIG. 11 is an exploded perspective view of the stitch density adjustment device.
Figure 12:
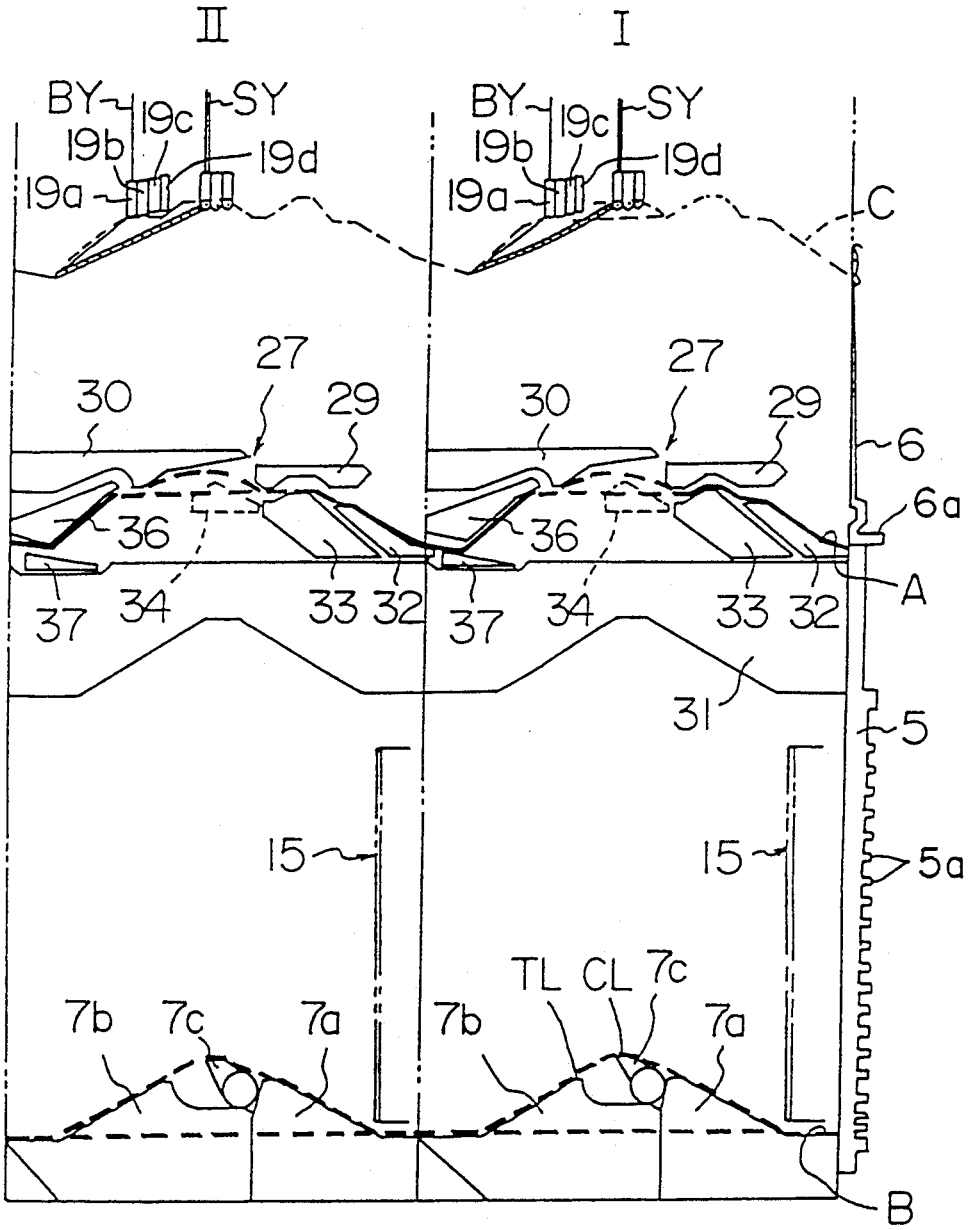
FIGS. 12 through 15 are developments similar to FIG. 2 for a description of the operational actions of the circular knitting machine of the invention.

More specifically, in each of the first knitting section I and the second knitting section II shown in FIGS. 1, 2, and 12, a supporting structure 39 (see FIGS. 3 to 11) is fixed integrally to a holding frame 28 (FIG. 1) of the knitting control cam unit 27 and is so mounted as to face the butts 6*a* of the knitting needles 6 of the knitting cylinder 2. As shown as a development in FIG. 2, a first guard cam 29 on the upstream side relative to the revolving direction of the knitting cylinder 2 and a second guard cam 30 on the downstream side are fixedly provided on each holding frame 28. A guide cam 31 below the first guard cam 29 is provided to guide the butts of the aforementioned jacks 5. As shown further in FIG. 2, between each first guard cam 29 and the guide cam 31, known control cams, i.e., a tucking cam 32, a clearing cam 33, and a transfer cam 34 are provided in the known manner, wherein they can advance and retract in the radial direction of the knitting cylinder 2 and they form operational passageway. Furthermore, below the second guard cam 30, a stitching cam 36 of a stitch density adjusting device 35 is so provided as to form operational passageway and to be movable up and down, and as to be capable of advancing and retracting in the radial direction of the knitting cylinder 2. Still further, there is provided, below the stitching cam 36, a cushion cam 37 which is capable of up-and-down motion together with the stitching cam 36 and forms an operational passageway.

The density adjusting device 35 is installed in each of the knitting sections I through VIII in order to carry out stitch density adjustment of the bulging and other configurations of the waist part and the breast part of a body suit or the like as shown in FIGS. 19*a* through 19*f*.

Figure 3:
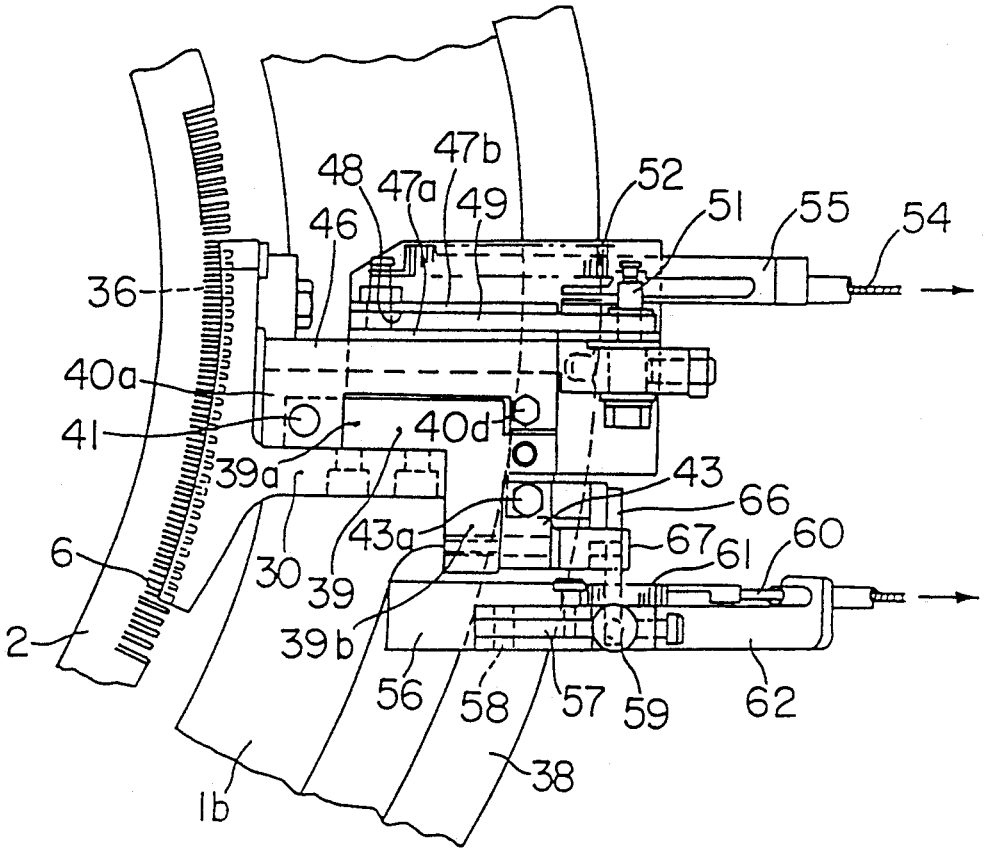
FIG. 3 is a plan view of a stitch density adjustment device of the circular knitting machine of the invention.
Figure 4:
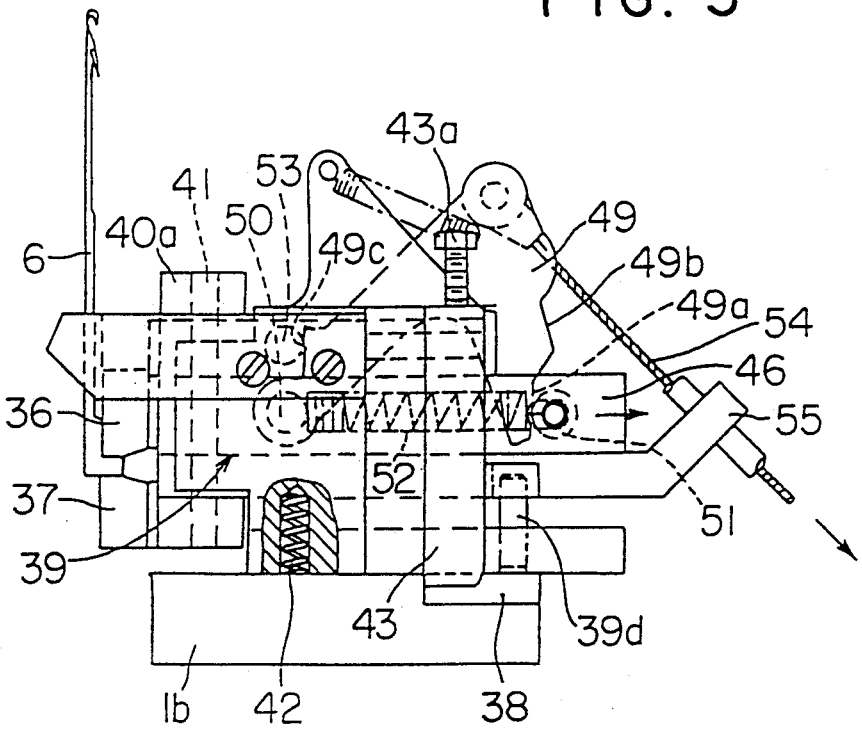
FIG. 4 is a side view of the same device.
Figure 5:
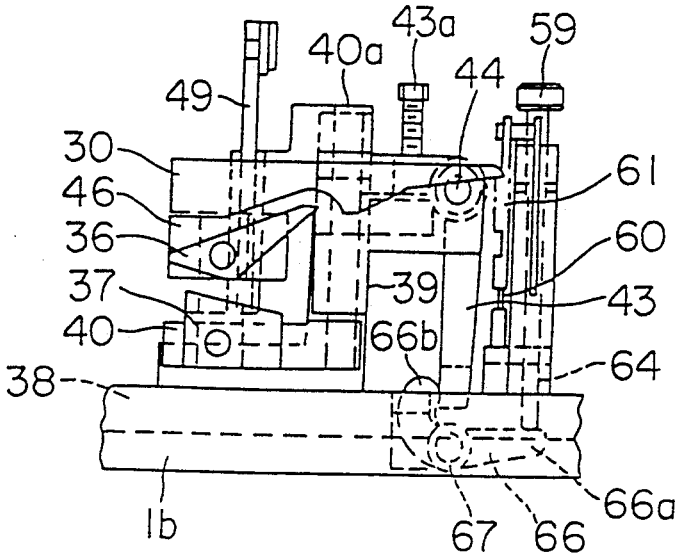
FIG. 5 is a front view of the same device.
Figure 8:
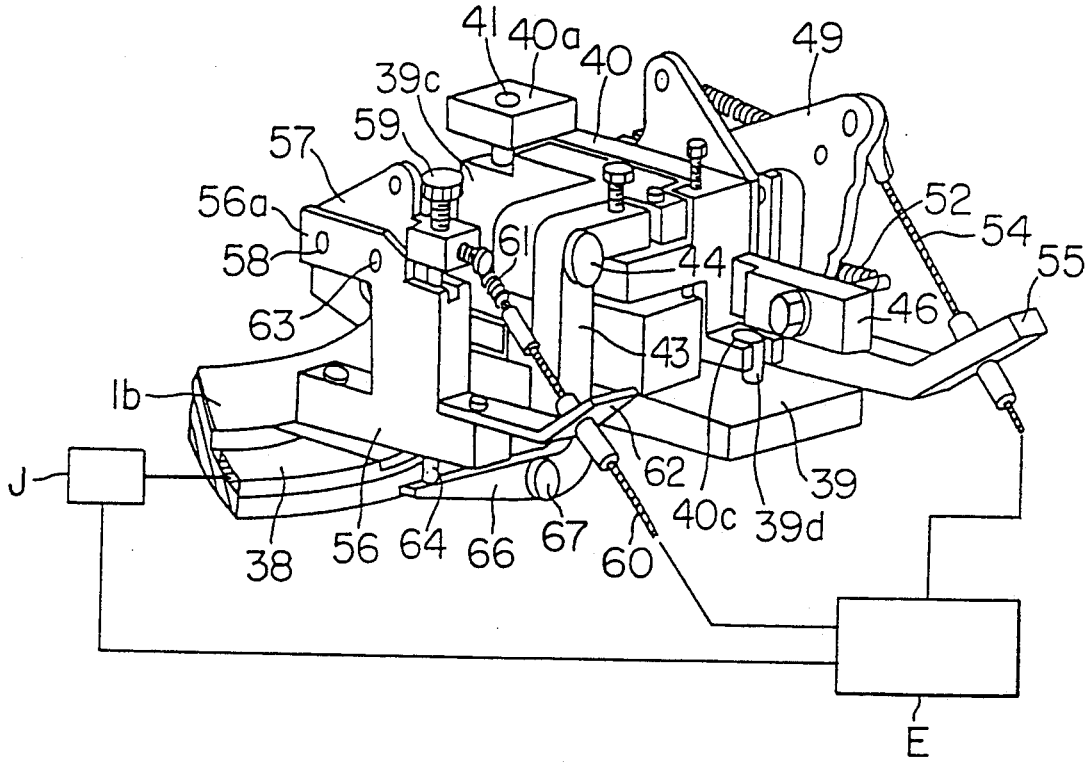
FIG. 8 is a perspective view as viewed from the outer side of the same device.

Referring to FIGS. 3 and 4, an operating ring 38 is provided around the outer periphery of the annular intermediate table 1*b* integral with the machine frame 1 so as to be actuated in an arcuately reciprocating sliding motion relative to the intermediate table 1*b* by an actuator J (FIG. 8). In the part of the intermediate table 1*b* in the vicinity of this operating ring 38, the aforementioned supporting structure 39, which is integral with the holding frame 28 (FIG. 1) of the knitting control cam unit 27, is mounted as indicated in the exploded perspective view of FIG. 11. The supporting structure 39 has a shape as shown in FIG. 11, and on this supporting structure 39 are formed plate parts 39*a* and 39*b* forming together an angle-shaped part. The plate part 39*a* extends radially toward the knitting cylinder 2 as shown in FIG. 3. The plate part 39*b* is formed to intersect perpendicularly the plate part 39*a*. At the end of the plate part 39*a*, a projection 39*c* (FIG. 11) is formed. On this projection 39*c*, projections 40*a* and 40*b* of a vertically movable member 40 are slidably connected by a guide pin 41 so as to be freely movable in the up-and-down direction. This vertically movable member 40 is urged upward by the force of a coil spring 42 (FIG. 4) provided in the support structure 39. Furthermore, on a side wall surface of the plate part 39*a* of the above described support structure 39, the aforedescribed second guard cam 30 is provided in fixed state. On the plate part 39*b*, an L-shaped actuation bar 43 is pivotally supported by a pivot pin 44.

At a front end part of the vertically movable member 40, the aforementioned cushion cam 37 is attached as indicated in FIG. 11. On one side wall of the vertically movable member 40, a guide groove 45 is formed horizontally in the radial direction of the knitting cylinder 2. In this guide groove 45, a stitching slider 46 having the aforementioned stitching cam 36 is slidably fitted to be slidable in the radial direction. At an outer end part of the vertically movable member 40, a forked part 40*c* is formed. In this forked part 40*c* engages a stop pin 39*d* (FIG. 4) imbeddedly fixed to the support structure. This stop pin 39*d* functions cooperatively with the guide pin 41 to guide the vertically movable member 40 in the up-and-down direction.

Figure 6:
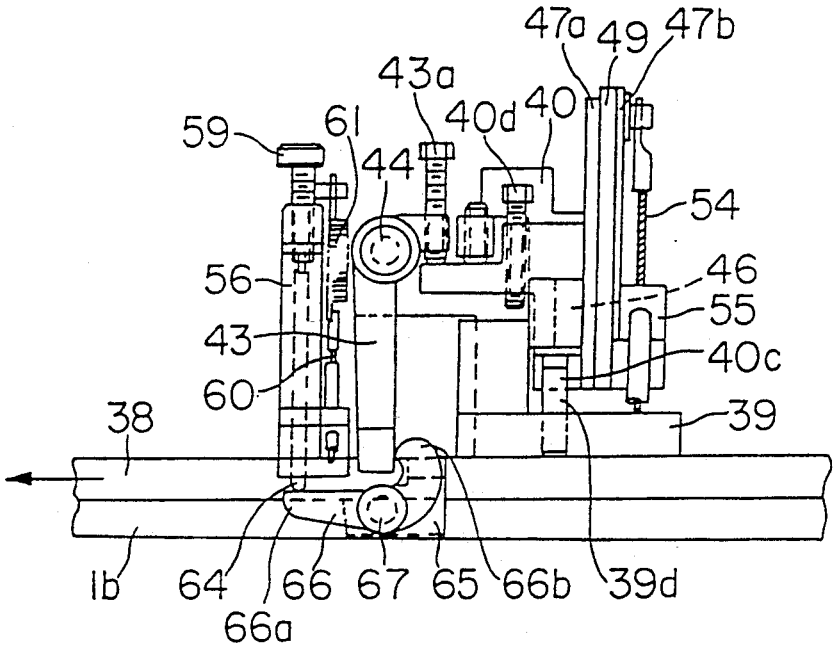
FIG. 6 is a rear view of the same device.
Figure 7:
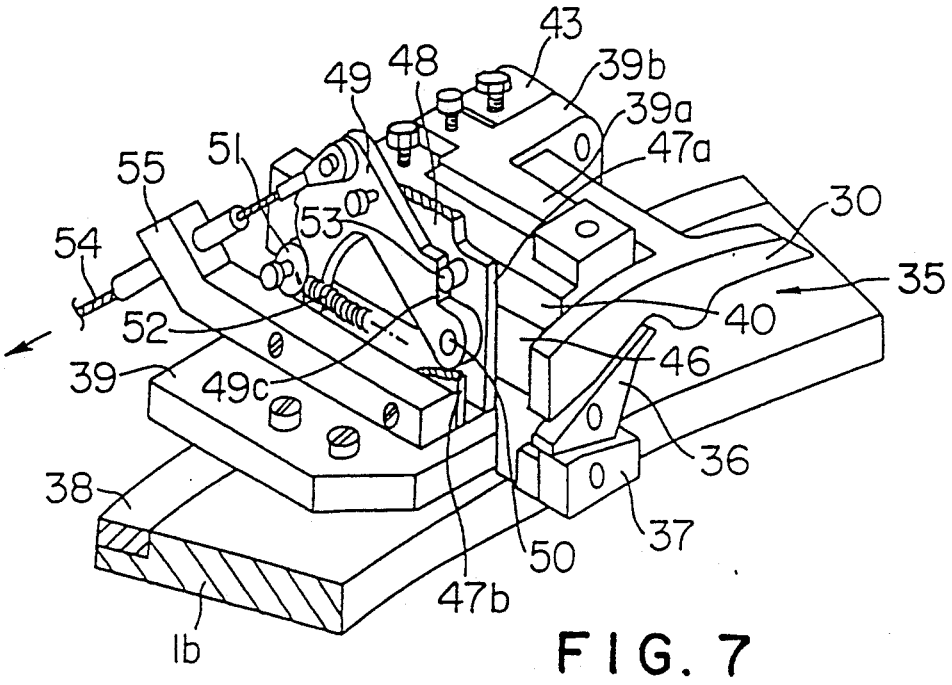
FIG. 7 is a perspective view as viewed from the inner side of the same device.

As shown in FIGS. 6 and 7, on one side of the vertically movable member 40 on the radially outer side of the stitching slider 46, cover members 47*a* and 47*b* constituting a pair are mounted with a spacing gap 48 therebetween, and within this gap 48, a hook-shaped cam lever 49 (FIGS. 4 and 7) is pivotally supported by a pivot shaft 50. Along the outer edge of this cam lever 49 are formed a first cam part 49*a* and a second cam part 49*b* as shown in FIG. 4. A roller pin 51 imbeddedly fixed to the stitching slider 46 is adapted to selectively contact the first cam part 49*a* and the second cam part 49*b*. The roller pin 51 is urged by the elastic force of a coil spring 52 to thrust the stitching slider 46 in the direction toward the central axis of the knitting cylinder 2. At the proximal root part of the cam lever 49, an engagement part 49*c* is formed. This engagement part 49*c* engages with a stop pin 53 fixed to the cover member 47*a* and regulates the position of the stitching slider 46, which is being subjected to the elastic force of the coil spring 52. To an edge part of the cam lever 49 is connected one end of an actuating cable 54. The other end of this actuating cable 54 is passed through a bracket 55 attached to the cover member 47*b* and is connected to a stitch density adjustment control circuit device E (FIG. 8). The stitch density adjustment control circuit device E operates to control the actuator J of the aforedescribed operating ring 38.

Figure 9:
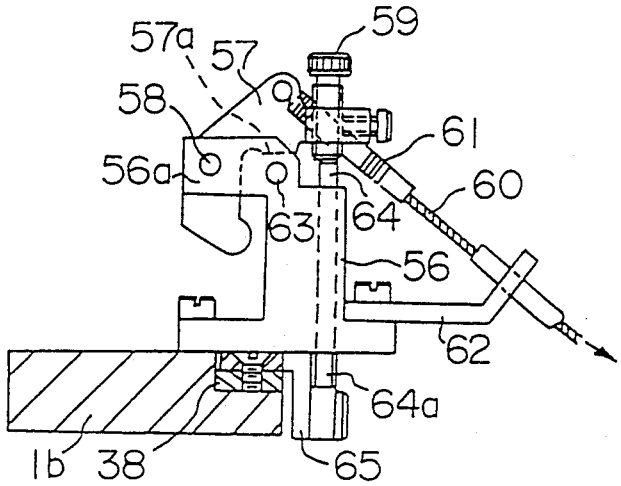
FIG. 9 is a side view showing one part of the stitch density adjustment device of the circular knitting machine of the invention.

As shown in FIGS. 6 and 8, on the support structure 39, in the vicinity of the aforedescribed actuation bar 43, a stand member 56 is mounted upright. At the upper part of this stand member 56, an extension 56*a* is formed. At the outer end of this extension 56*a*, as shown in FIG. 9, a pushing lever 57 of bell-crank shape is pivotally supported by a pivot pin 58. Into one part of this pushing lever 57, an adjustment screw 59 is screwed. Also, to the stand member 56, in the vicinity of this adjustment screw, an actuating cable 60 is connected by way of a coil spring 61. The other end of this actuating cable 60 is passed through a bracket 62 attached to the stand member 56 and connected to the aforedescribed stitch density adjustment control device E (FIG. 8).

Figure 10:
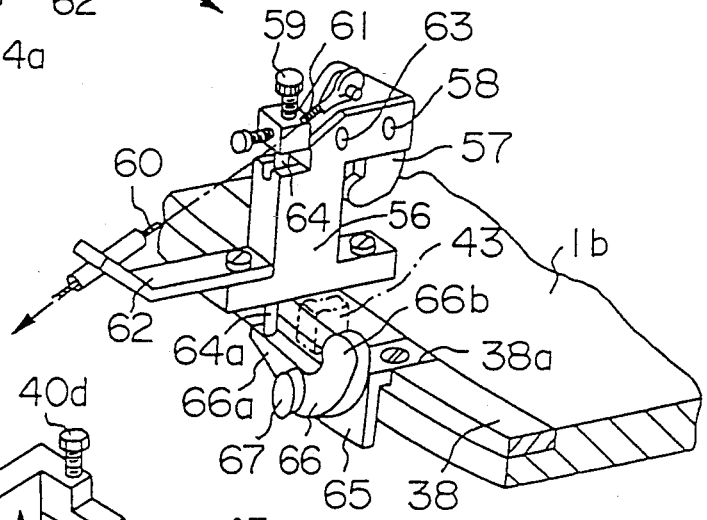
FIG. 10 is a perspective view of the same device.

As shown in FIG. 9, a stop 63 is attached to the extension 56*a*. This stop 63 functions to set the position of the pushing lever 57 when its contact face 57*a* contacts this stop 63. Furthermore, as shown in FIGS. 9 and 10, through the stand member 56, immediately below the adjustment screw 59, a push rod 64 is loosely fitted. In the vicinity of the lower end 64*a* of this push rod 64, a cutout part 38*a* (FIG. 10) is formed in the operating ring 38. In this cutout part 38*a*, a mounting bracket 65 of angle shape is inserted and fixed. On this mounting bracket 65, a rockable lever 66 is pivotally supported by a pivot pin 67. One arm 66*a* of this rockable lever 66 is in contact with the lower end 64*a* of the push rod 64, while the other arm 66*b* of this rockable lever 66 is adapted to push and move the lower part of the aforedescribed actuation bar 43 (FIG. 6).

As shown in FIGS. 6 and 11, an adjustment screw 40*d* for setting the lowermost position of descent of the aforedescribed vertically movable member 40 is screw-fitted therein so as to abut against the support structure 39. At one part of the actuation bar 43, an adjustment screw 43*a* is screw-fitted therein so as to abut against the vertically movable member 40.

The knitting control cam unit 27 of the aforedescribed construction is provided in each of the knitting sections I through VIII.

The aforementioned stitch density adjusting device 35 operates in accordance with the operation of the density adjustment control device E to controllably adjust the density in the following manner with respect to the knitting sections I through VIII in the case, for example, where the stitch densities of the waist portion of a body suit of FIGS. 19*a* through 19*f* are to be adjusted.

(a). The case of coarse-density knitting by lowering simultaneously each stitching cam 36 and cushion cam 37 independently of the other knitting sections.

On the basis of a command from the density adjustment control device E (FIG. 8), the actuating cable 60 is pulled in the arrow direction indicated in FIG. 9 counter to the elastic force of the coil spring 61, whereby the pushing lever 57 rotates in the clockwise direction around the pivot pin 58. Consequently the adjustment screw 59 screw-fitted in this pushing lever 57 presses downward one arm 66*a* of the rockable lever 66 by way of the push rod 64. Therefore, as shown in FIG. 6, the other arm 66*b* of the rockable lever 66 pushes the lower part of the actuation bar 43. Accordingly, the actuation bar 43 together with the adjustment screw 43*a* integral therewith push the vertically movable member 40 downward counter to the elastic force of the coil spring 42 (FIG. 4), whereby the stitching cam 36 and the cushion cam 37 mounted on the vertically movable member 40 are simultaneously lowered and assume their state for coarse-density knitting.

In this connection, in place of the above described actuating cable 60, for example, an actuator driven by a pneumatic cylinder device, a hydraulic cylinder device, or an electromagnetic device may be coupled to the pushing lever 57.

(b). The case of coarse-density knitting from fine density (dense) by lowering simultaneously and altogether the stitching cams 36 and the cushion cams 37 of all knitting sections I through VIII.

On the basis of a command from the density adjustment control device E, the actuator J (FIG. 8) pushes the operating ring 38 in the arrow direction indicated in FIG. 6. Thereupon the actuation bar 43 and the adjustment screw 43 integral therewith together push the vertically movable member 40 downward counter to the elastic force of the coil spring 42 (FIG. 4). Therefore, the stitching cams 36 and the cushion cams 37 provided on all vertically movable members 40 descend simultaneously and in toto, whereby the state for knitting coarse density is assumed. This is suitable for knitting the parts of increasing diameter over the entire periphery. Also, by controlling in the reverse direction from coarse density to fine density, the waist part is knitted.

On the basis of a command from the density adjustment control device E, the density adjusting device 35 of each knitting section is controlled from fine density to coarse density, whereby bulges or distended parts over portions in the peripheral direction of the body suit shown in FIGS. 19*a*, 19*b*, 19*c*, 19*d*, and 19*f*, for example, bulges C of the breast part and bulges of the hip part d and the hip part of the panties g, can be readily knitted.

(c). The case of knitting a composite pattern of a spiral pattern and a motif pattern in the body suit a or petticoat f shown in FIGS. 19*a* and 19*e*.

Figure 13:
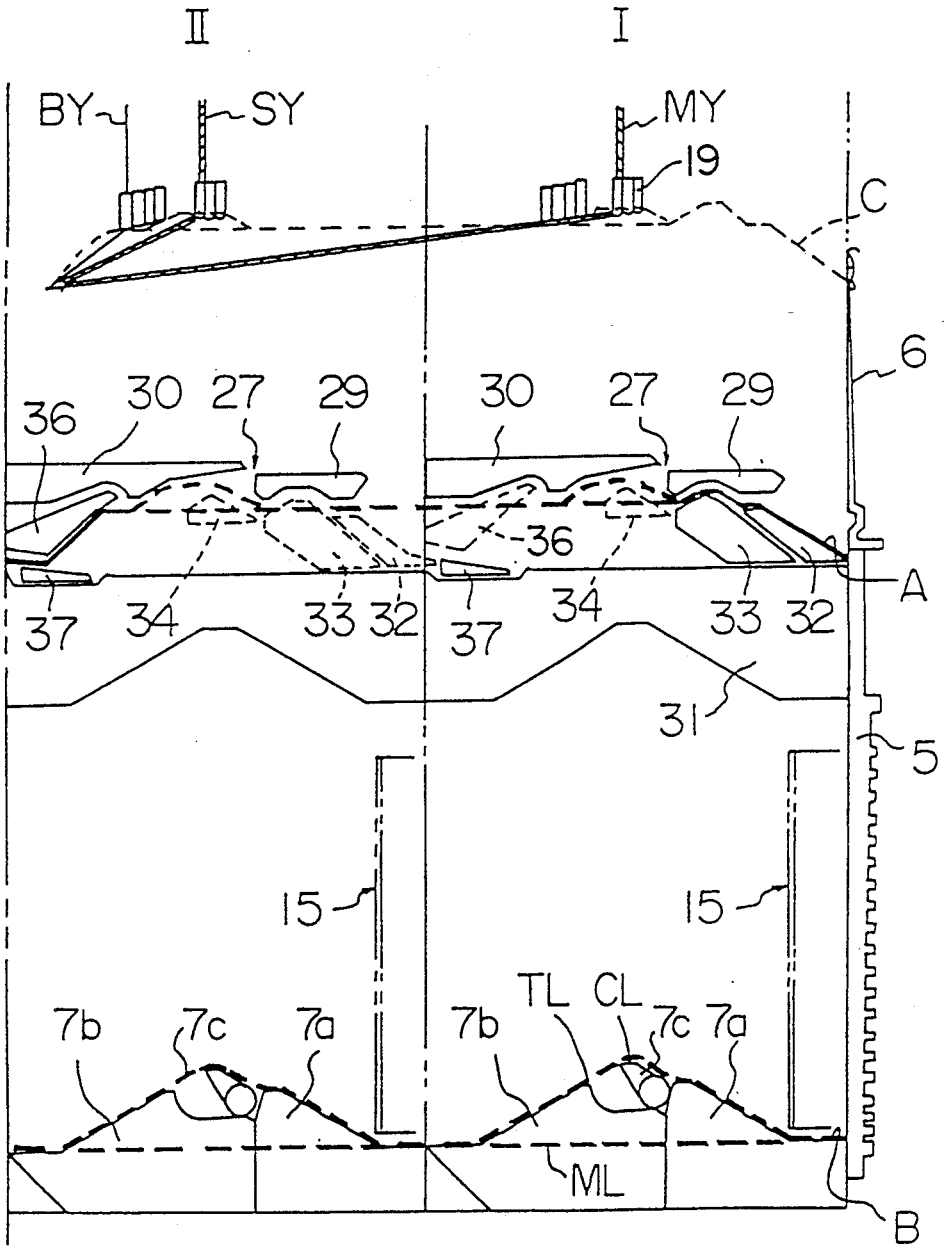

In order to place a knitting needle 6 in its inoperative state, the transfer cam 34 and the stitching cam 36 of the first knitting section I are retracted outwardly in the radial direction as indicated by intermittent lines in FIG. 13. That is, in the state shown in FIGS. 4 and 7, in response to a command from the stitch density adjustment control device E, the aforedescribed actuating cable 54 is pulled in the arrow direction indicated in FIG. 4 counter to the elastic force of the coil spring 52, whereby the cam lever 49 rotates clockwisely about the pivot shaft 50. For this reason, the roller pin 51 imbeddedly provided on the stitching slider 46 contacting the first cam part 49*a* of the cam lever 49 moves toward and contacts the second cam part 49*b*. Thereupon, the stitching slider 46 causes the stitching cam 36 integral therewith to shift outward in the radial direction of the knitting cylinder 2 under the elastic force of the coil spring 52 and thereby retract.

In this manner, a composite pattern of a spiral pattern and a motif pattern can be knitted in a body suit or the like as shown in FIGS. 19*a* through 19*f*.

Next, the procedures of knitting various patterns will be described.

(1). Knitting a spiral pattern of a body suit or the like shown in FIGS. 19*a* through 19*f*.

The knitting control cam units 27 of all knitting sections I through VIII (sections up to knitting section IV shown) are placed in the same state as the knitting control cam units 27 of the first and second knitting sections I and II shown in FIG. 12.

Referring to FIG. 12, the thick lines A and B in the first knitting section I and the second knitting section II indicate the path through which the butts of the knitting needles 6 pass and the path through which the lower parts of the jacks 5 pass. The thin line (intermittent line) C in the first knitting section I and the second knitting section II indicates the path through which the hooks of the knitting needles 6 pass.

As indicated in FIG. 2, each yarn feeding device 19 is prepared beforehand so as to supply ground yarn BY from the yarn path 19*a* thereof and spiral pattern forming yarn SY from the spiral pattern forming yarn path thereof. Separately, the tucking cam 32, the clearing cam 33, the stitching cam 36, and the cushion cam 37 of the knitting control cam unit 27 acting on each knitting needle 6 are placed in their advanced state so as to actuate the knitting needles 6 of the knitting cylinder as indicated by solid line. The transfer cam 34 is placed in its retracted state so as to inactivate the knitting needles 6 of the knitting cylinder 2 as indicated by intermittent line.

Furthermore each swing cam 7*c*, through which the lower parts of the jacks 5 pass is placed in its upright state so as to be at the clearing level CL.

Therefore, when the knitting cylinder 2 revolves, all knitting needles 6 ascend to the clearing level CL to clear the tuck cams 32 and the clearing cams 33 and thereafter descend to the tuck level TL at the first guard cam 29. Also, the knitting needles 6 at the tuck level TL and the jacks 5 selected by the needle selecting lever 17 of the aforedescribed patterning device 15 are lifted by the lifting jack cam 7*a* and, further, are lifted by the swing cam 7*c* up to the clearing level CL. As a result, the knitting needles on the jacks 5 reach the clearing level CL, and the knitting needles 6 at the tuck level TL and the knitting needles at the clearing level CL together pass through the operational passageway of the second guard cam 30, the stitch cam 36, and the cushion cam 37 due to the portioned distribution of the ground yarn BY and the spiral pattern forming yarn SY from the yarn paths thereby to knit a spiral pattern forming pattern.

In this manner, similar spiral knitting is carried out also in the other knitting sections II through VIII, whereby a spiral pattern of the body suit or the like as indicated in FIGS. 19*a* through 19*f* is knitted.

(2). Knitting a composite pattern of a spiral pattern and a motif pattern of a body suit or the like indicated in FIGS. 19*a* through 19*f*.

In this case, in the knitting sections I through VIII indicated in FIGS. 2 and 13 (in which knitting sections up to knitting section IV are shown), knitting is carried out with adjacent knitting sections, such as the first knitting section I and the second knitting section II, as one pair.

Prior to this knitting operation, the yarn feeding devices 19 are so prepared beforehand that motif pattern yarn MY will be fed from the spiral pattern forming yarn path will be fed from the yarn feeding device 19 in the first knitting section I, and that, in the second knitting section II, ground yarn BY will be fed from the yarn paths of the yarn feeding device 19 similarly as in the case illustrated in FIG. 12, and spiral pattern forming yarn SY will be fed from the spiral pattern forming yarn paths of the spiral pattern forming yarn paths of the yarn feeding device 19.

In FIG. 13, similarly as in the case indicated in FIG. 12, in the first knitting section I and the second knitting section II, the thick lines A and B indicate the path of the butts of the knitting needles 6 and the path of the lower parts of the jacks 5, and, in the first knitting section I and the second knitting section II, the thin line (intermittent line) C indicates the path of the hooks of the knitting needles 6.

The tucking cam 32, the clearing cam 33, and the cushion cam 37 of the knitting control cam unit 27 that act on the knitting needles 6 in the first knitting section I are placed beforehand in their advanced state as indicated by solid line so as to actuate the knitting needles 6 of the knitting cylinder 2. The transfer cam 34 and the stitching cam 36 are placed in their retracted state as indicated by intermittent line so as to render inactive the knitting needles of the knitting cylinder 2. In addition, the tucking cam 32, the clearing cam 33, and the transfer cam 34 of the second knitting section II are placed in their retracted state as indicated by intermittent line so as to inactivate the knitting needles 6 of the knitting cylinder 2. The stitching cam 36 and the cushion cam 37 are placed in their advanced state as indicated by solid line so as to actuate the knitting needles 6 of the knitting cylinder 2.

Furthermore, each swing cam 7*c* along which the lower ends of the jacks 5 pass in the first knitting section I and the second knitting section II is placed in its erect state to be at its clear level CL.

Therefore, as the knitting cylinder 2 revolves, the knitting needles 6 are lifted up to the clearing level CL by the tuck cam 32 and the clearing cam 33 and are then lowered to the tuck level TL by the first guard cam 29. Thereafter these knitting needles 6 at the tuck level TL and the jacks 5 selected by the needle selecting lever 17 of the aforedescribed patterning device 15 are lifted by the lifting jack cam 7*a* and further lifted up to the clearing level CL by the swing cam 7*c*.

The knitting needles 6 above the jacks 5 which have risen to the clearing level CL rise from the tuck level TL to the clearing level CL, and a motif pattern yarn MY is caught on these knitting needles 6 at the clearing level CL. However, since the transfer cam 34 and the stitching cam 36 of the first knitting section I have been placed in retracted states, as indicated by intermittent line, so as to inactivate the knitting needles of the knitting cylinder 2, the knitting needles 6 on which the motif pattern yarn MY has been caught move on as they are to the second knitting section II. Then, since the tucking cams 32, the clearing cams 33, and the transfer cams 34 in the second knitting section II are in their retracted states, as indicated by intermittent line, so as to inactivate the knitting needles 6 of the knitting cylinder 2, the knitting needles 6 on which the motif pattern yarn MY is caught carry out knitting of the spiral pattern as described in conjunction with FIG. 12 and, at the same time, carry out also knitting of the motif pattern MY. Thus knitting of a composite pattern can be carried out.

In this manner, by carrying out similar knitting also in the other knitting sections III through VIII, knitting of a composite pattern of a spiral pattern and a motif pattern MY of a body suit or the like shown in FIGS. 19*a* through 19*f* can be carried out.

In the case of stitch density adjustment of the waist portion of the body suit or the like of FIGS. 19*a* through 19*f*, all of the stitch density adjusting devices 35 installed in all knitting sections I through VIII as described hereinbefore are operated together at the same time by way of the operating ring 38. In the case of knitting of a local bulge, the operating ring 38 is not operated, but the stitch density adjusting devices 35 of the respective knitting sections are operated separately as described hereinbefore.

(3). Spiral knitting of a tuck pattern of a body suit or the like shown in FIGS. 19*a* through 19*f*, that is, knitting a composite pattern of a tuck pattern and a spiral pattern.

Figure 14:
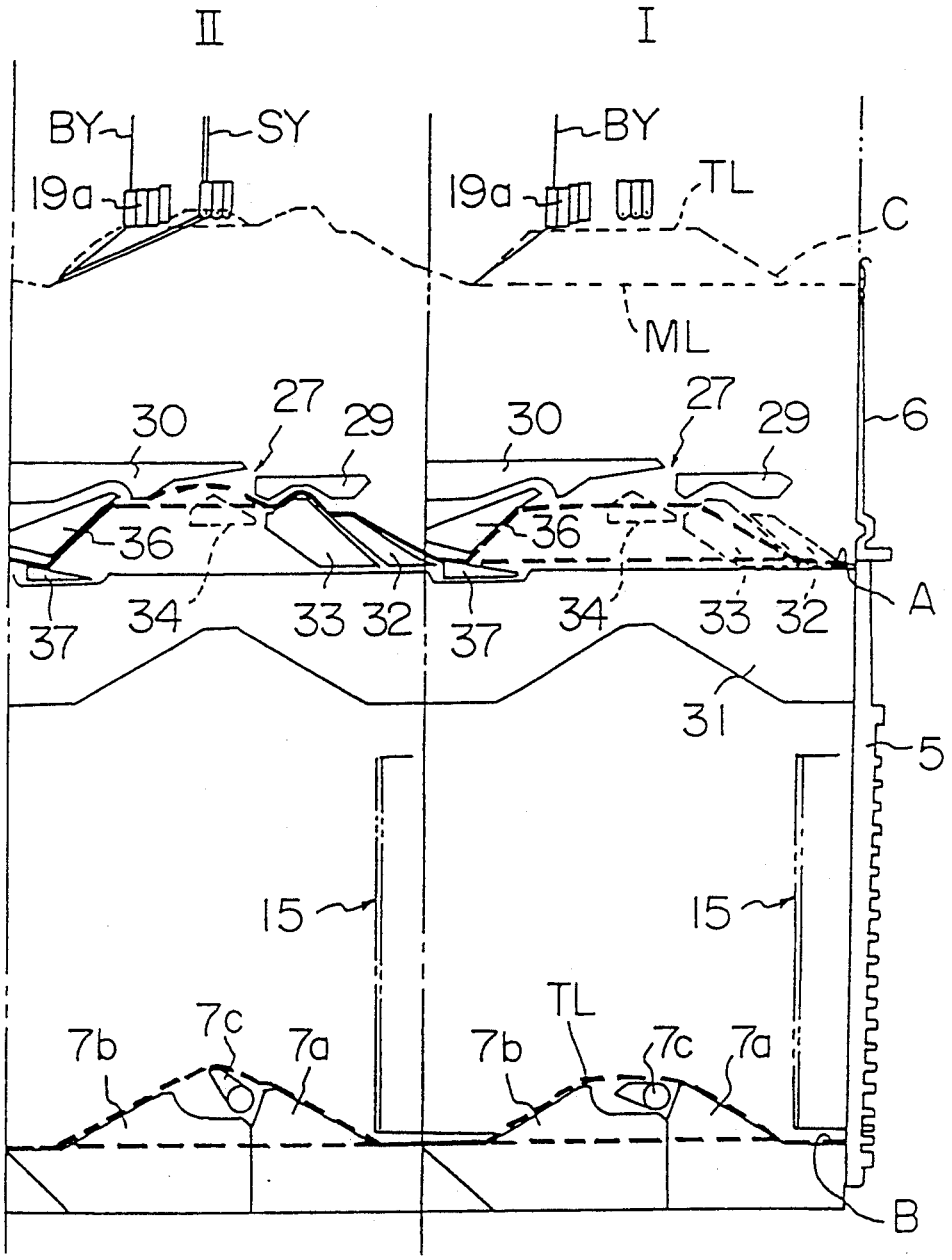

In the knitting sections I through VIII shown in FIGS. 2 and 14 (up to knitting station IV being shown), knitting is carried out with adjacent knitting sections, such as the first knitting section I and the second knitting section II, as a pair.

First, preparations are made beforehand so that ground yarn By can be fed from the yarn paths of the yarn feeding device 19 in the first knitting section I. Further, in the second knitting section II, preparation is made so as to feed ground yarn BY from the yarn paths of the yarn feeding device 19 and also spiral pattern forming yarn SY from the spiral pattern forming yarn paths of the yarn feeding device 19 similarly as in the case illustrated in FIG. 12.

In this connection, in FIG. 14, similarly as in the case shown in FIG. 12, the thick lines A and B indicate the path through which the knitting needles 6 pass and the path through which the lower parts of the jacks 5 pass in the first knitting section I and the second knitting section II, the thin (intermittent) line C indicates the path through which the hooks of the knitting needles 6 pass in the first knitting section I and the second knitting section II.

The tucking cam 32, the clearing cam 33, and the transfer cam 34 of the knitting control cam unit 27 to act on the knitting needles 6 in the first knitting section I are placed and left in their retracted states, as indicated by intermittent line, so as to inactivate the knitting needles 6 of the knitting cylinder 2. The stitching cam 36 and the cushion cam 37 are placed and left in their advanced state, as indicated by solid line, so as to activate the knitting needles 6 of the knitting cylinder 2. In addition, the tuck cam 32, the clearing cam 33, the stitching cam 36, and the cushion cam 37 of the second knitting section II are placed and left in their advanced state, as indicated by solid line, so as to activate the knitting needles 6 of the knitting cylinder 2. The transfer cam 34 of the second knitting section II is placed and left in its retracted state, as indicated by intermittent line, so as to inactivate the knitting needles 6 of the knitting cylinder 2.

Further, the swing cam 7*c* past which the lower parts of the jacks 5 are to travel in the first knitting section I is placed and left in its downwardly swung state so as to be at the tuck level TL. Also, the swing cam 7*c* past which the lower parts of the jacks 5 are to travel in the second knitting section II is placed and left in its erect state so as to be at the clear level CL.

Therefore, when the knitting cylinder 2 revolves, the knitting needles 6 pass along a miss level ML because of the tucking cam 32, the clearing cam 33, and the transfer cam 34 being in the inactive state, but the jacks 5 selected by the needle selecting lever 17 of the patterning device 15 are lifted by the lifting jack cams 7*a* and travel as they are at the tuck level TL. Accordingly, the knitting needles 6 above the jacks 5 at the tuck level TL also travel as they are at the tuck level TL.

On the other hand, the knitting needles 6 at the miss level ML miss the ground yarn BY and become non-knitting, while the knitting needles 6 above the jacks 5 at the tuck level TL carries out tuck knitting of the stitching cam 36 with the ground yarn BY together with the leading loops. The knitting needles 6, after knitting of the tuck pattern, knit the spiral pattern in the second knitting section II similarly as described in conjunction with FIG. 12. Thus, a composite pattern of a tuck pattern and a spiral pattern is knit by the first knitting section I and the second knitting section II.

In the above described manner, similar knitting is carried out also by the other knitting sections III through VIII, whereby knitting of a composite pattern of a tuck pattern and a spiral pattern of a body suit or the like shown in FIGS. 19*a* through 19*f* can be carried out.

(4). Knitting a composite pattern of a Jacquard pattern and a spiral pattern of a body suit or the like shown in FIGS. 19*a* through 19*f*.

Figure 15:
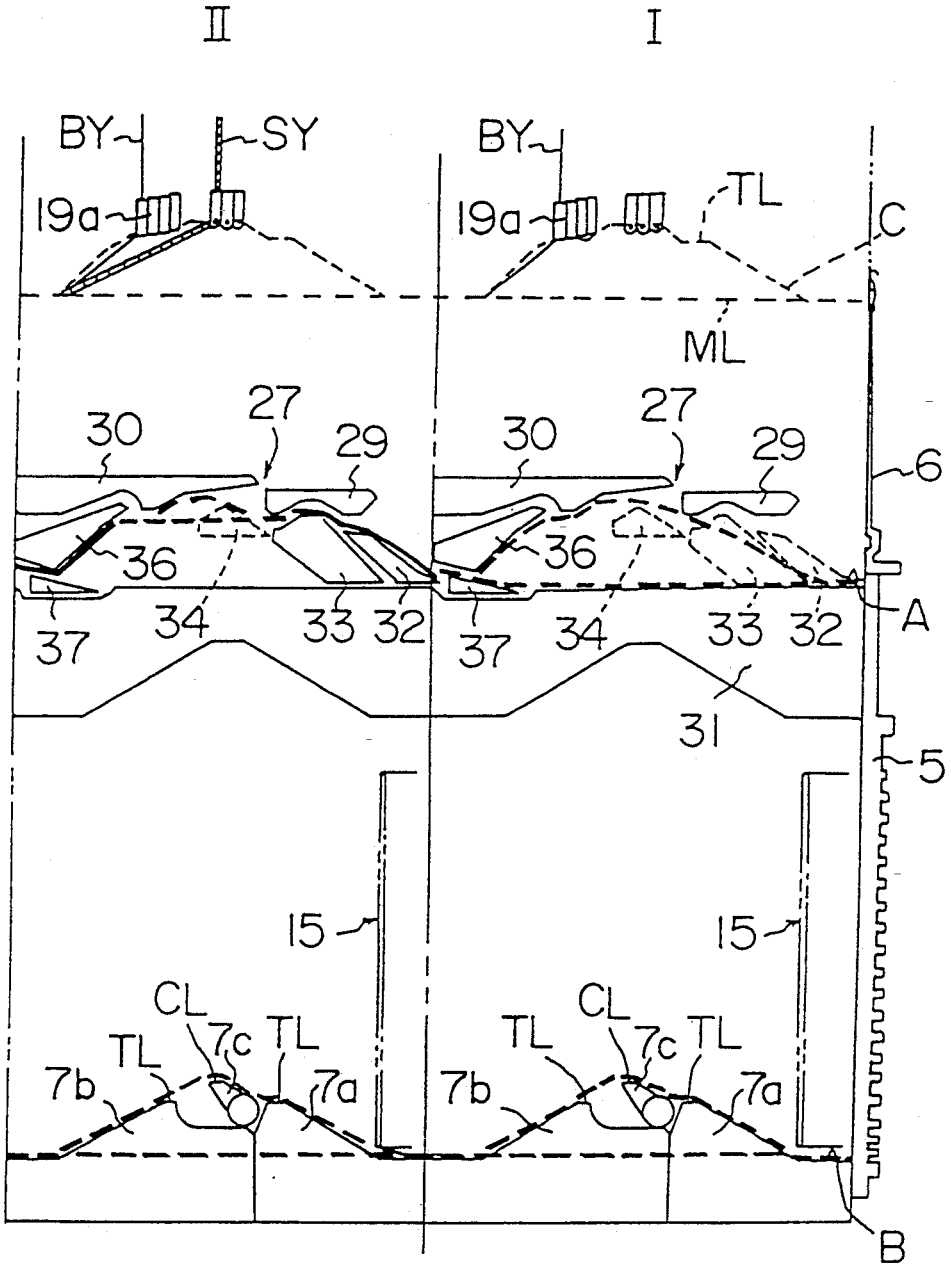

In the knitting sections I through VIII indicated in FIGS. 2 and 15 (knitting stations up to IV shown in these figures), knitting is carried out with the first knitting section I and the second knitting section II as one pair.

Beforehand, preparation is made so that ground yarn BY will be fed from the ground yarn path of the ground yarn feeding device 19 in the first knitting section I. Further, in the second knitting section II, preparation is made beforehand so that ground yarn BY will be fed from the yarn paths of the yarn feeding device 19, and spiral pattern forming yarn SY will be fed from the spiral yarn paths of the yarn feeding device 19, similarly as in the case of FIG. 12.

In this connection, in FIG. 15, similarly as in the case illustrated in FIG. 12, in the first knitting section I and the second knitting section II, the thick lines A and B indicate the path along which the butts of the knitting needles 6 pass and the path along which the lower parts of the jacks 5 pass respectively. In the first knitting section I and the second knitting section II, the thin line (intermittent line) C indicates the path along which the hooks of the knitting needles 6 pass.

The tucking cam 32, the clearing cam 33, and the transfer cam 34 of the knitting control cam unit 27 that act on the knitting needles 6 in the first knitting section I are placed and left in their retracted states as indicated by intermittent line so as to inactivate the knitting needles of the knitting cylinder 2. The stitch cam 36 and the cushion cam 37 are placed and left in their advanced stares as indicated by solid line so as to activate the knitting needles of the knitting cylinder 2.

Further, the tucking cam 32, the clearing cam 33, the stitching cam 36, and the cushion cam 37 of the second knitting section II are placed and left in their advanced states as indicated by solid line so as to activate the knitting needles 6 of the knitting cylinder 2. Also, the transfer cam 34 of the second knitting section II is placed and left in its retracted state as indicated by intermittent line so as to inactivate the knitting needles 6 of the knitting cylinder 2.

In addition, the swing cams 7c past which the lower parts of the jacks 5 pass in the first knitting section I and the second knitting section II are placed and left in their erect state so as to be at the clearing level CL.

Therefore, as the knitting cylinder 2 revolves, the knitting needles 6 pass through the miss level ML since the tucking cams 32, the clearing cams 33, and the transfer cams 34 are in their inactivating states. However, the jacks 5 selected by the needle selecting lever 17 of the patterning device 15 are lifted by the lifting jack cams 7a, and the knitting needles 6 above the jacks 5 at the clearing level CL ascend from the miss level ML to the clearing level CL. The knitting needles 6 at the miss level ML miss the ground yarn BY and assume a non-knitting state, and the above mentioned knitting needles 6 at the clearing level CL is caused to carry out knitting of the ground yarn BY in a Jacquard pattern by the stitching cams 36. The knitting needles 6 after this Jacquard pattern knitting knit the spiral pattern in the succeeding second knitting section II similarly as described in conjunction with FIG. 12. Thus, a composite pattern of a Jacquard pattern and a spiral pattern is knit in the first knitting section I and the second knitting section II.

By knitting a Jacquard pattern and a spiral pattern in the same manner also in the other knitting sections III through VIII, knitting of a composite pattern of a Jacquard pattern and a spiral pattern of a body suit or the like as shown in FIGS. 19a through 19f can be carried out.

While knitting of only a spiral pattern, a composite pattern of a spiral pattern and a motif pattern, a composite pattern of a tuck pattern and a spiral pattern, and a composite pattern of a Jacquard pattern and a spiral pattern of a body suit or the like as shown in FIGS. 19a through 19f has been described above, composite patterns such as those of a motif pattern and a tuck pattern, a motif pattern and a Jacquard pattern, a tuck pattern and a Jacquard pattern, and a tuck pattern and Jacquard pattern can be accomplished by suitably combining the yarn feeders and the cams of the knitting control cam units.

Furthermore, in order to knit knitwear such as body suits, brassieres, petticoats, and pants as illustrated in FIGS. 19a through 19f, the characteristic of spiral knitting for garment length knitting of the neck part, sleeve opening part, and leg opening part can be utilized, and for cutting the garment-length-knit parts of the spiral pattern forming yarn or cutting of parts other than the pattern part of the motif yarn at the time of knitting a motif pattern, the cutter device 26 shown in FIG. 1 is used. Further, after press forming, cutting can be done along the shaping line with scissors.

Next, with respect to FIGS. 16a and 16b, mock-pile knitting of the bust part c and the leg part d and the bust parts el of the brassiere as shown in FIGS. 19a through 19f will now be described.

Figure 16A:
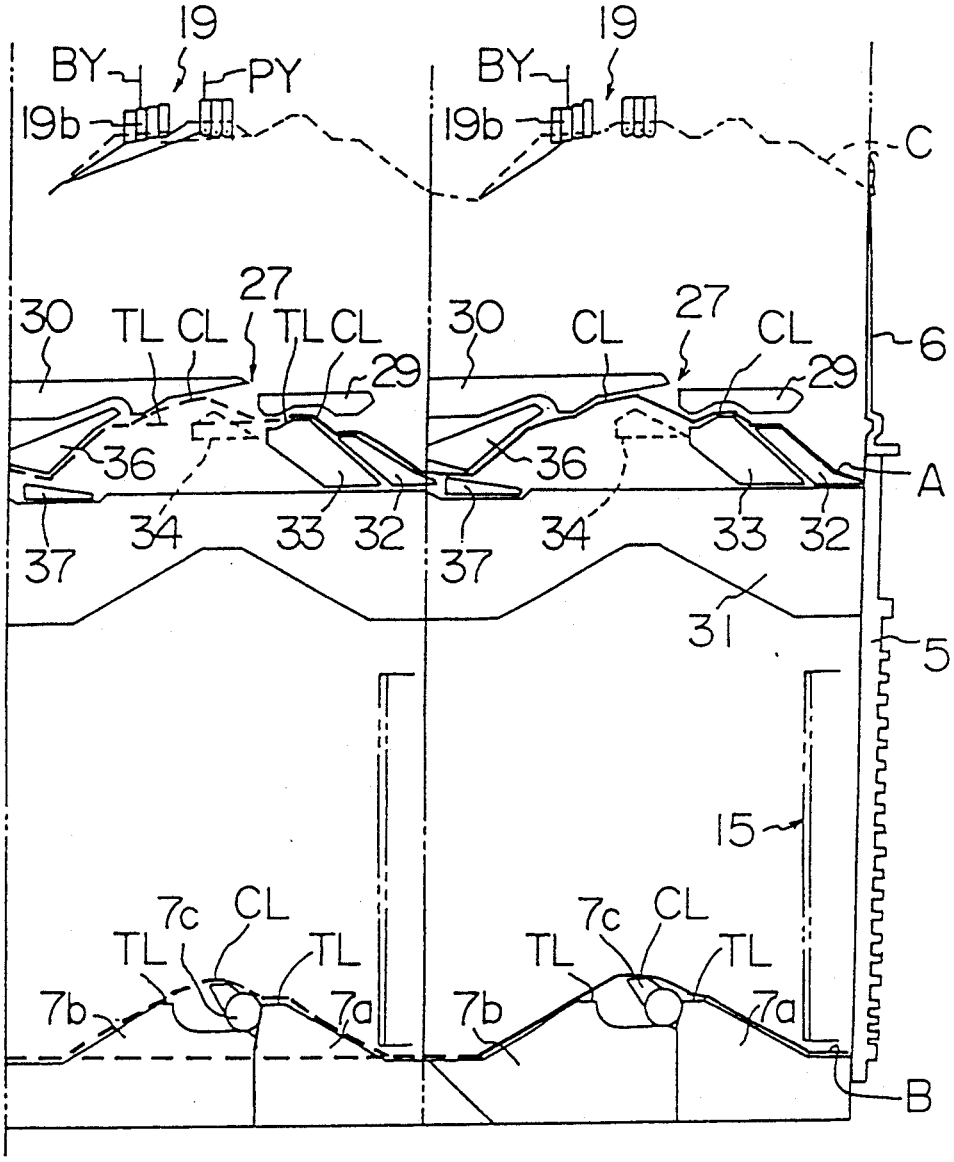
FIG. 16*a* is a development indicating the states of cams of a knitting section during mock pile knitting.
Figure 16B:
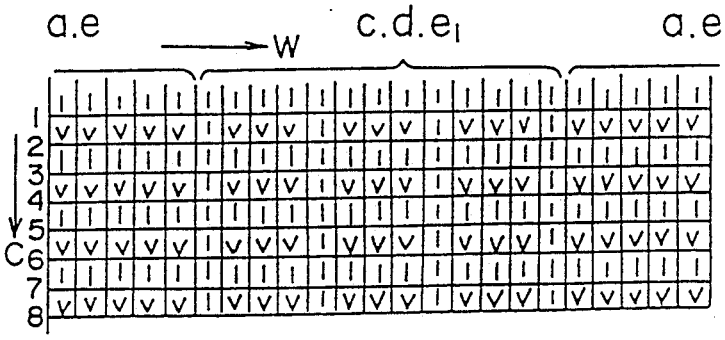
FIG. 16*b* is a knitting texture diagram corresponding to FIG. 16*a;*

(1) FIG. 16a represents the first knitting section I and the second knitting section II within the entire knitting sections for mock-pile knitting, while FIG. 16b shows a partial knitting design (according to J.I.S. standard indication) of a mock-pile knitting. The arrow mark in this FIG. 16b indicates the wale direction, while the arrow mark c of FIG. 16b indicates the course direction. Further, the reference symbol "1" indicates knit, while reference symbol "v" indicates float.

The range a.e of FIG. 16b indicates plain stitch parts of the body suit a and the brassiere, while the range c.d.$e_1$ of FIG. 16b indicates the bust part c and Crotch part d of the body suit a and the bust part $e_1$ of the brassiere e.

Previously, in the first knitting section I in FIG. 16a, ground yarn BY is fed from the ground yarn path 19b of the yarn feeding device 19. In the second knitting section II, ground yarn BY is fed from the ground yarn path 19b of the yarn feeding device 19, and also pile yarn is fed from the pile yarn path of the yarn feeding device 19.

The tucking cams 32, the clearing cams 33, the transfer cams 34, the stitching cams 36, the cushion cams 37, and the swing cams 7c of the knitting control cam units 27 of the first knitting section I and the second knitting section II are respectively set is the same states as those indicated in FIG. 12.

At the time of operation of the circular knitting machine, the needle selecting lever 17 of the patterning device 15 for actuating the jacks 5 of the first knitting section I is placed in the inactive state, and the swing cams 7c of the first knitting section I are raised to and left in their operative state. Also, the needle selecting lever 17 of the patterning device 15 for actuating the jacks 5 of the second knitting section II is placed in its operative state, and the swing cams 7c of the second knitting section II are raised to and left in their operative states. Further, the symbols knit "1" and float "v" of the knitting design of FIG. 16b are inputted beforehand into a patterning control circuit (not shown) so that the needle selecting lever 17 of the patterning device 15 of the second knitting section II will selectively actuate the jacks 5. At the time of knitting, the needle selecting lever 17 of the patterning device 15 selectively actuates the jacks 5 on the basis of signals from this patterning control circuit.

Therefore, after the knitting needles 6 which have been lifted to the clearing level CL by the tucking cam 2 and the clearing cam 33 of the first knitting section I are pressed downward to the tuck level TL by the first guard cam 29, all jacks 5 are lifted due to the inoperative state of the patterning device 15 to the clearing level CL by the jack cam 7a and the swing cam 7c. All knitting needles 6 thus lifted together with this also ascend to the clearing level CL, and, when being lowered by the stitching cam 36, all knitting needles 6 carry out plain stitch knitting with the odd-number 1 courses in the course direction of the knitting design of FIG. 16b as knit "1", being supplied with ground yarn BY.

Next, the knitting needles 6 which have been lifted to the clearing level CL by the tucking cam 32 and the clearing cam 33 of the second knitting section II are pressed downward to the tuck level TL by the first guard cam 29. Thereafter the jacks 5 are selectively actuated by the needle selecting lever 17 of the patterning device 15, and these jacks 5 are selectively moved to the miss level ML or the tuck level TL to be attained by the lifting jack cam *7a*. Further, the jacks 5 which have been lifted to the tuck level TL by this lifting jack cam *7a* is raised to the clearing level CL by the swing cam *7c*, and the knitting needles 6 above these jacks 5 at the clearing level CL and the knitting needles 6 at the tuck level TL carry out knitting of a mock pile with ground yarn BL and pile yarn PY supplied from the yarn feeding device 19.

That is, as is indicated in the partial knitting design of the mock pile knitting of FIG. 16*b*, the sequential order of selection of the jacks 5 which has been inputted beforehand into the patterning control circuit will be taken as one example. Then, in the case of repetition of the operation wherein two courses of course c of FIG. 16*b* are in the direction of wale w, knit "1" is "1 wale w", and float "v" is "3 wales w", the knitting needles 6 at the clearing level CL operate on both the ground yarn BY and the pile yarn PY as knit "1". Although the knitting needles 6 at the tuck level TL knit ground yarn BY from pile knitting, the pile yarn PY is knit as float "v", and the float "v" "3 wale w" thus floated becomes a slack portion at the back side of the ground yarn BY, whereby a mock pile is knitted.

In this connection, the odd-number courses 1, 3, 5, and 7 in the course direction c of the knitting design of FIG. 16*b* are knitted respectively in the knitting sections I, III, V, and VII. The even-number courses 2, 4, 6, and 8 in the course direction c of the knitting design of FIG. 16*b* are knitted respectively in the knitting sections II, IV, VI, and VIII. Although the ratio of knit "1" to float "v" in the range c.d.$e_1$ is mode 1:3, a zigzag or cross-stitch combination may also be used.

Figure 17A:
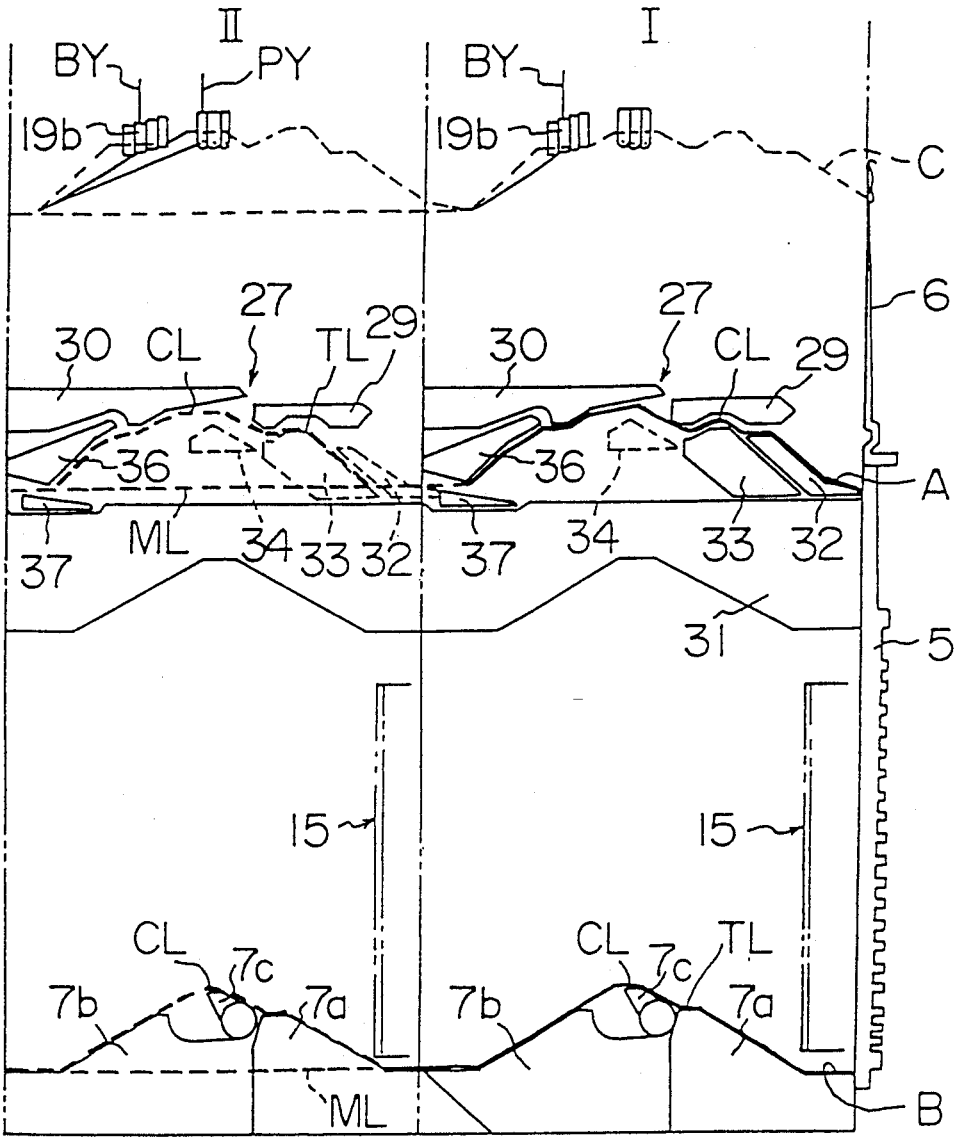
FIG. 17*a* is a development indicating the states of cams of a knitting section during another mode of mock pile knitting.
Figure 17B:
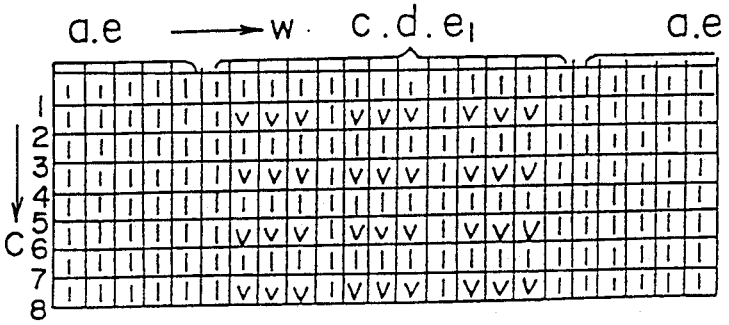
FIG. 17*b* is a knitting texture diagram corresponding to FIG. 17*a;*

(2). FIG. 17*a* shows the first knitting section I and the second knitting section II among all knitting sections for knitting another mock pile. FIG. 17*b* indicates a partial knitting design (according to JIS standard indication) of the mock pile knitting. The arrow mark of this FIG. 17*b* designated the wale direction, while the arrow mark c of FIG. 17*b* designated the course direction. Further, the symbol "1" indicates knit, while the symbol "v" indicates float.

Similarly as in the case of FIG. 16*b*, the ranges a.e of FIG. 17*b* indicates plain knitting portions of a body suit a and a brassiere e, and the range c.d.$e_1$ of FIG. 17*b* indicates the bust portion c and the leg portion d of the body suit a and the bust portion $e_1$ of the brassiere e.

Previously, in the first knitting section I in FIG. 17*a*, ground yarn BY is fed from the ground yarn path 19*b* of the yarn feeding device 19. In the second knitting section II, ground yarn BY is fed from the ground yarn path 19*b* of the yarn feeding device 19, and further, pile yarn PY is fed from the pile yarn path of the yarn feeding device 19.

Next, the tuck cam 32, the clearing cam 33, the stitching cam 36, the cushion cam 37, and the swing cam *7c* of the knitting control cam unit 27 of the first knitting section I are respectively set in the same states as those indicated in FIG. 12. Also, the stitching cam 36, the cushion cam 37, and the swing cam *7c* of the knitting control cam unit 27 of the second knitting section II are in their operative state, having advanced to the side of the knitting machine cylinder 2, and the tucking cam 32, the clearing cam 33, and the transfer cam 34 of the knitting control cam unit 27 of the second knitting section II are in their inoperative state, being retracted from the side of the knitting machine cylinder 2. Further, the swing cam *7c* of the second knitting section II is left in its erect state.

At the time of operation of the circular knitting machine, the needle selecting lever 17 of the patterning device 15 for actuating the jacks 5 of the first knitting section I is placed in its inoperative state, and the swing cam *7c* of the first knitting section I is in its raised operative state. The needle selecting lever 17 of the patterning device 15 for actuating the jacks 5 of the second knitting section II is placed in its operative state, and the swing cam *7c* of the second knitting section II is in its raised operative state. Further, the symbols knit "1" and float "v" of the knitting design of FIG. 17*b* have been previously inputted into a patterning control circuit (not shown) so that the jacks 5 will be selectively actuated by the needle selecting lever 17 of the patterning device 15 of the second knitting section II, whereby, at the time of knitting, the needle selecting lever 17 of the patterning device 15 operates in response to signals from this patterning control circuit to selectively actuate the jacks 5.

Therefore, the knitting needles 6 which have been lifted to the clear level CL by the tuck cam 32 and the clearing cam 33 of the first knitting section are pressed down to the tuck level TL by the first guard cam 29. Thereafter, because of the inoperative state of the patterning device 15, all jacks 5 are lifted to the clear level CL by the lifting jack cam *7a* and the swing cam *7c*. All of the knitting needles 6 which have ascended together with this also ascend to the clear level CL. When they are lowered by the stitching cam 36, all knitting needles 6 carry out plain knitting with knit "1" along the odd-number course 1 in the course direction c of the knitting design of FIG. 17*b* being fed with ground yarn BY.

Next, in the second knitting section II, the jacks 5 are selectively actuated by the needle selecting lever 17 of the patterning device 15, and these jacks 5 are selectively directed to the miss level ML and by the lifting jack cam 7 to the rising tuck level TL. The jacks 5 which have been lifted by the lifting jack cam *7a* to the tuck level TL are lifted by the swing cam *7c* to the clear level CL. When the knitting needles 6 above these jacks 5 at the clear level CL are lowered by the stitching cam 36, ground yarn BY from the ground yarn finger 19*b* of the yarn feeding device 19 and pile yarn PY are both directed to knit "1". On the other hand, the knitting needles 6 above the jacks 5 at the miss level ML pass through the miss level ML and are floated "v". This float "v" 3 wale becomes a slack on the back side of the ground yarn BY, and mock pile knitting is carried out. The differences between FIGS. 17*a* and 17*b* and FIGS. 16*a* and 16*b* are that: in the knitting design in FIG. 17*b*, the range a.e in the wale direction w is all made knit "1" in the course direction c; there are no floated yarn; and there is no cutting by means of a cutter device.

Figure 18A:
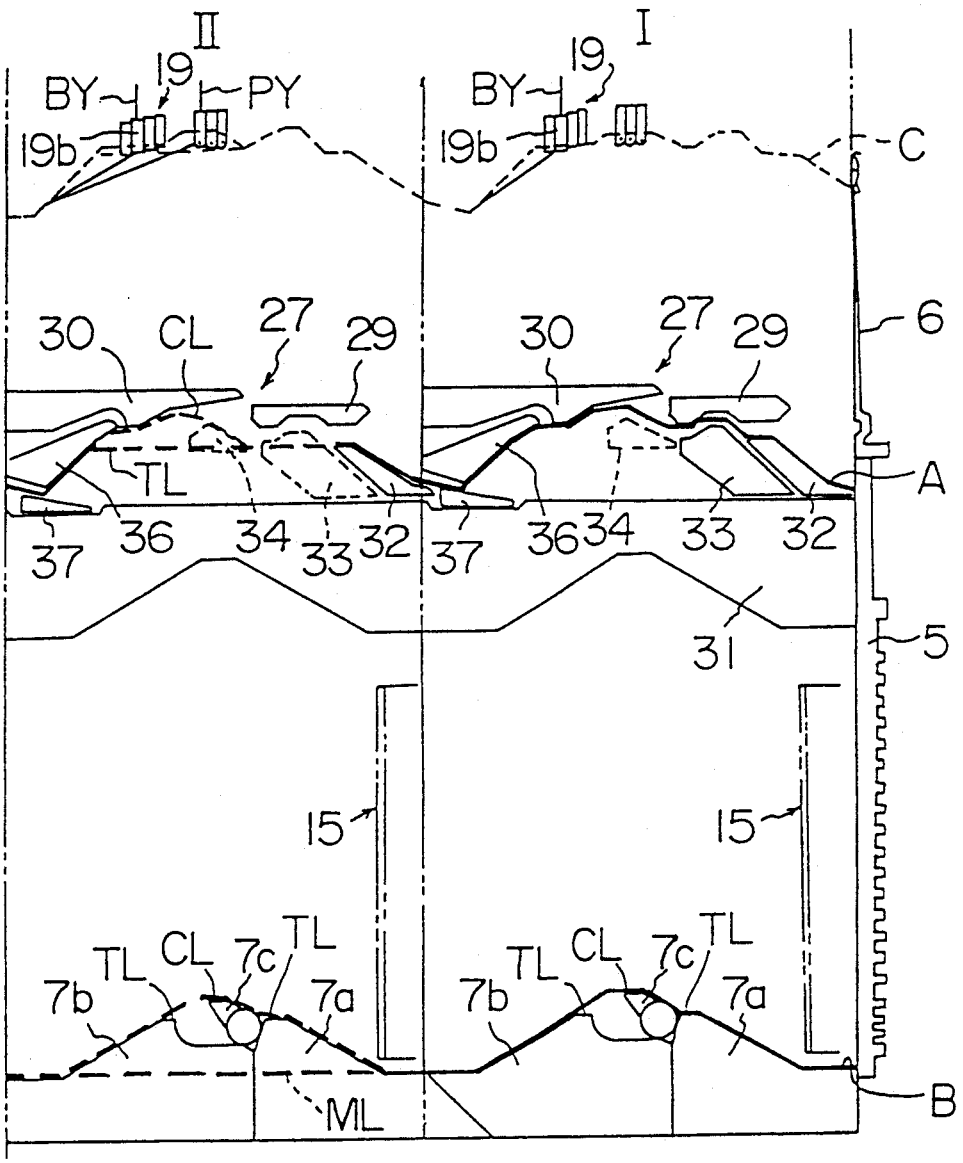
FIG. 18*a* is a development indicating the states of cams of a knitting section during still another mode of mock pile knitting.
Figure 18B:
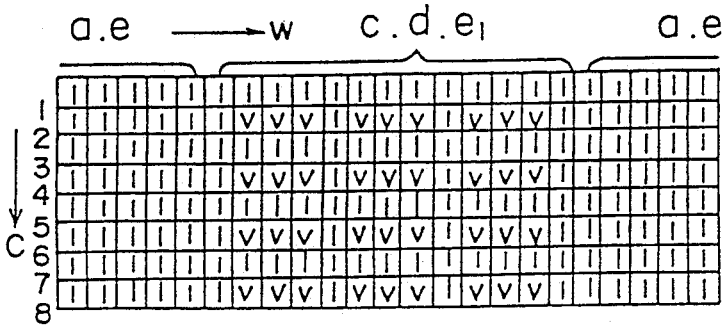
FIG. 18*b* is a knitting texture diagram corresponding to FIG. 18*a;*
Figure 19A:
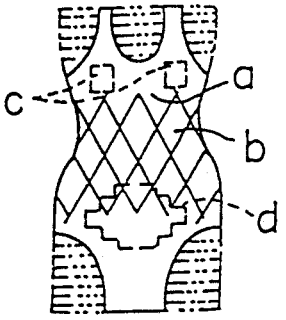
FIGS. 19*a* through 19*f* are descriptive views showing a body suit and the like which can be knitted by means of the knitting machine of the invention.
Figure 19D:
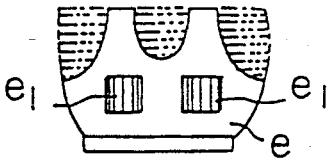
Figure 19B:
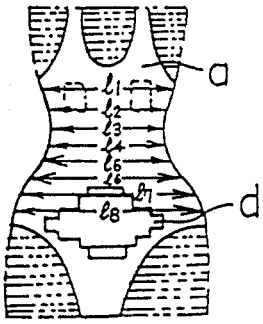
Figure 19E:
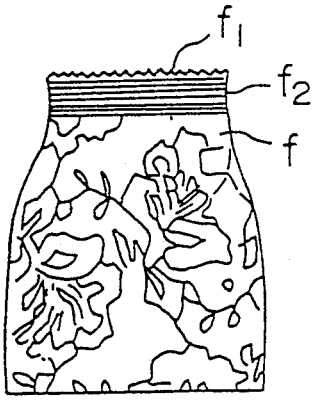
Figure 19C:
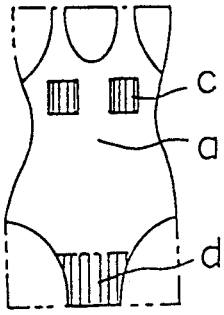
Figure 19F:
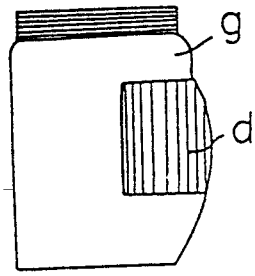

(3) Finally, FIG. 18*a* shows the first knitting section I and the second knitting section II of the entire group of knitting sections for knitting another mock pile, and FIG. 18*b* shows a partial knitting design (according to JIS standard indication) of the mock pile knitting.

In the first knitting section I in FIG. 18*a*, ground yarn BY is previously fed from a ground yarn path 19*b* of the yarn feeding device 19, and in the second knitting section II, ground yarn BY is fed from a ground yarn path 19*b* of the yarn feeding device 19. Also, pile yarn PY is fed from a pile yarn path of the yarn feeding device 19.

The tuck cam 32, the clearing cam 33, the stitching cam 36, the cushion cam 37, and the swing cam 7*c* of the knitting control cam unit 27 of the first knitting section I are respectively set in the states as those indicated in FIG. 12. The tucking cam 32, the stitching cam 36, the cushion cam 37, and the swing cam 7*c* of the knitting control cam unit of the second knitting section II are in their operative state, being advanced toward the knitting machine cylinder 2 side. The clearing cam 33 and the transfer cam 34 of each knitting control cam unit 27 of the second knitting section II are retracted from the knitting machine cylinder 2 side and are in inactive state. Further, the swing cam 7*c* of the second knitting section II is left in its erect state.

At the time of operation of the circular knitting machine, the needle selecting lever 17 of the patterning device 15 for actuating the jacks 5 of the first knitting section I is in its inoperative state, and each swing cam 7*c* of the first knitting section I is raised in operative state. Also, the needle selecting lever 17 of the patterning device 15 for actuating the jacks 5 of the second knitting section II is in operative state, and each swing cam 7*c* of the second knitting section II is raised in operative state. Further, the symbols knit "1" and float "v" of the knitting design of FIG. 18*b* have previously been inputted into a patterning control circuit (not shown) so that the jacks 5 will be selectively actuated by the needle selecting lever 17 of the patterning device 15 of the second knitting section II. At the time of knitting, the jacks 5 are selectively actuated by the needle selecting lever 17 of the patterning device 15 operating in response to signals from this patterning control circuit.

Therefore, a knitting needle 6 which has been lifted to the clearing level CL by a tucking cam 32 and a clearing cam 33 of the first knitting section I is pressed down to the tuck level TL by the first guard cam 29. Thereafter, since the patterning device 15 is in the inoperative state, all jacks 5 are lifted to the clearing level CL by the lifting jack cam 7*a* and the swing cam 7*a*. Then all knitting needles 6 which has ascended together with this also ascend to the clearing level CL and are lowered by the stitching cam 36, whereupon, being fed with ground yarn BY, all knitting needles 6 carry out plain knitting with knit "1" in the odd-number 1 course in the course direction c of the knitting design of FIG. 18*b*.

Next, in the second knitting section II, the jacks 5 are selectively actuated by the needle selecting lever 17 of the patterning device 15. These jacks 5 are selected to the tuck level TL to which they are lifted by the lifting jack cam 7*a*. A jack which has been lifted to the tuck level by the lifting jack cam 7*a* is lifted to the clearing level CL by the swing cam 7*c*.

On the other hand, the knitting needles 6 in the second knitting section II are lifted to the tuck level TL by the tucking cam 32 and, because the clearing cams 33 are in the inoperative state, are divided into knitting needles 6 passing by the tuck level TL and knitting needles 6 above the jacks 5 at the clearing level CL and ascend to the clearing level CL. When the knitting needles 6 are lowered by the stitching cams 36, they carry out knitting of a mock pile with the ground yarn BY from the ground yarn path 19*b* of the yarn feeding device 19 and the pile yarn PY.

In this specific example, the range a.e in the wale direction w of the knitting design is entirely knit "1" in the course direction c, whereby there is no yarn to be floated, and there is no cutting action by means of the cutter device 26.

FIGS. 20 through 26*b* illustrate another embodiment of a circular knitting machine which is capable of forming a knitted portion of a pile knitting fabric partially in a knitwear.

In this embodiment, in each of the sinker grooves 10 as shown in FIG. 1, a pile sinker for knitting a net of a fineness of, for example, middle gauge or fine gauge (14 NPI to 32 NPI) is inserted.

Figure 20:
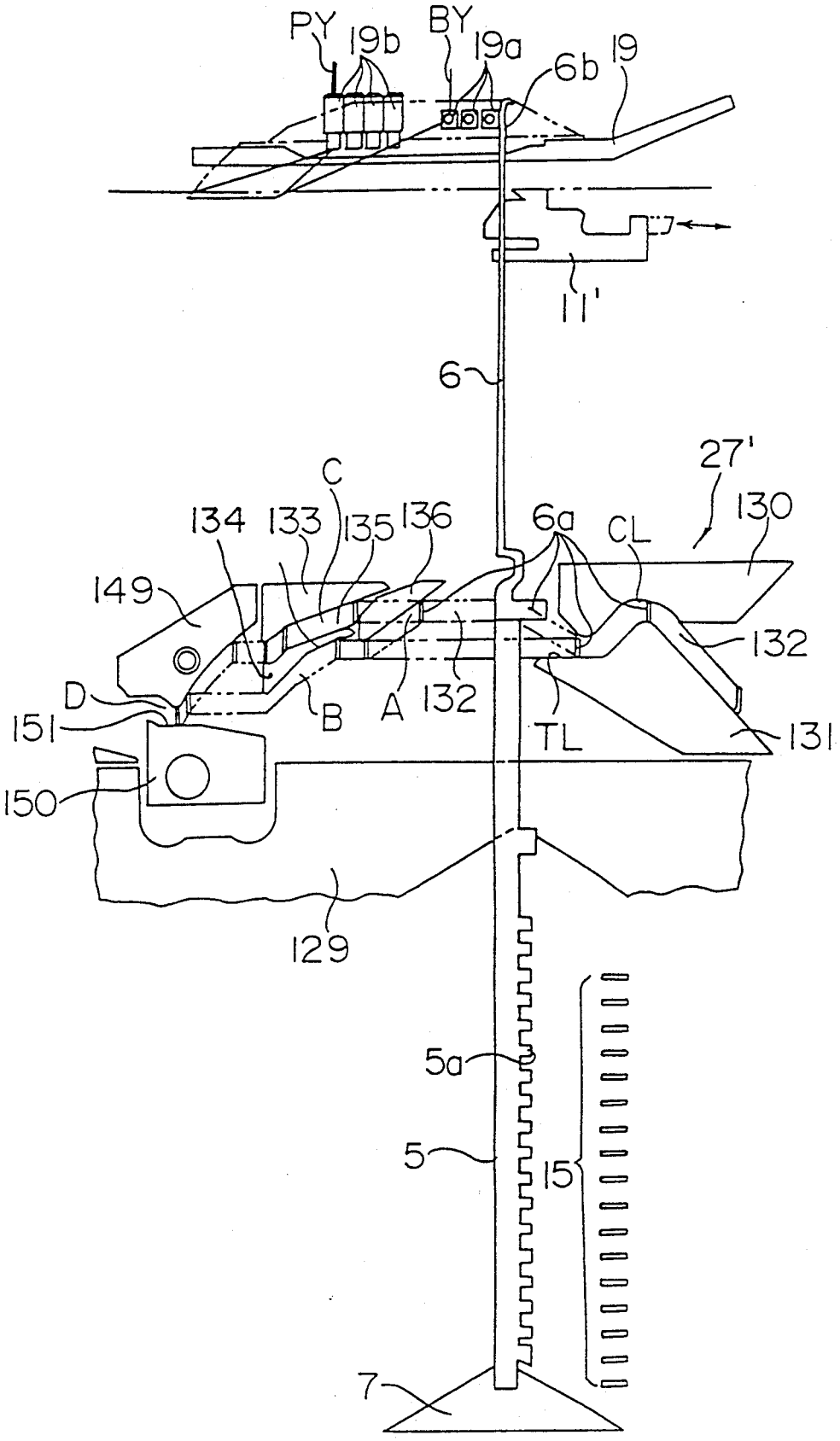
FIG. 20 is a partial view showing another embodiment of the circular knitting machine of the invention having a pile knitting device.

In this embodiment, as shown in FIG. 20, an inner surface cam 129 is fixedly mounted in the holding frame 28. Also, above this inner surface cam 129, a first guard cam 130 and a clearing cam 131 are so mounted on the holding frame 28 as to form a guide passageway 132 at the clearing level CL and the tuck level TL of the butts 6*a* of the knitting needles 6. In this connection, in FIG. 20, a tucking cam corresponding to the tucking cam 32 shown in FIG. 2 is used but is not shown. Further, below the yarn finger 19*b* of the yarn feeding device 19, a second guard cam 133 and an auxiliary stitching cam 134 of a knitting control cam unit 27′ are so mounted on the holding frame 28 as to form a C operation passageway 135 of the butts 6*a* of the knitting needles 6. In the neighborhood of the second guard cam 133 and the auxiliary stitch cam 134, a movable lowering cam 136 is so provided on the holding frame 28 that it can slide freely in the radial direction of the knitting machine cylinder 2.

Figure 21:
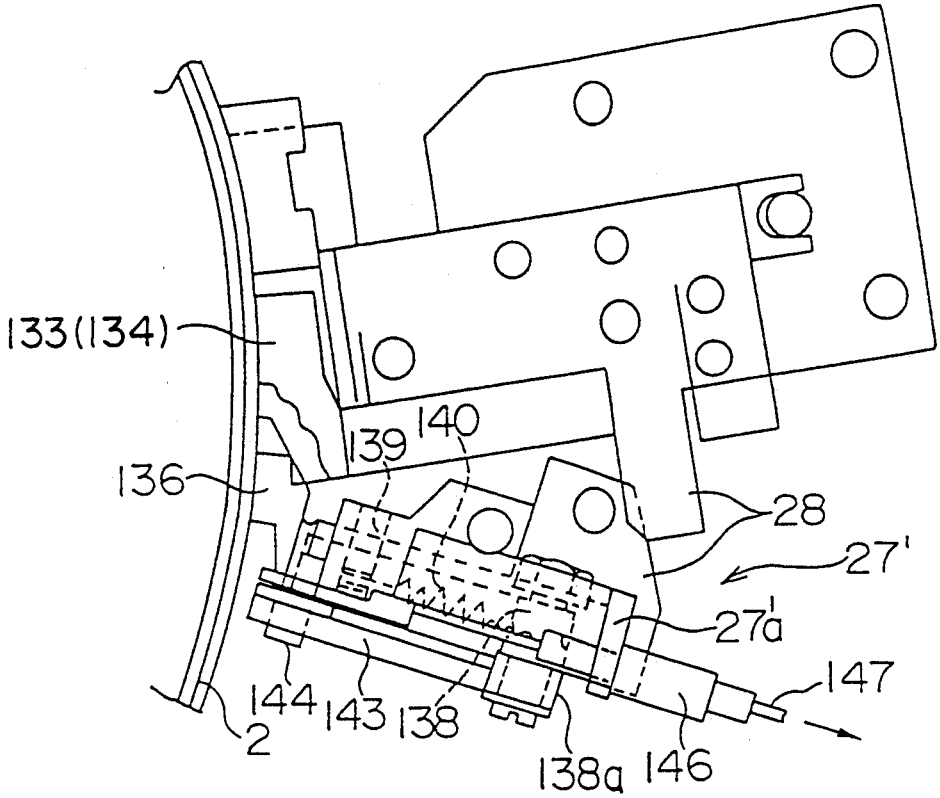
FIG. 21 is a partial plan view of the same.
Figure 22:
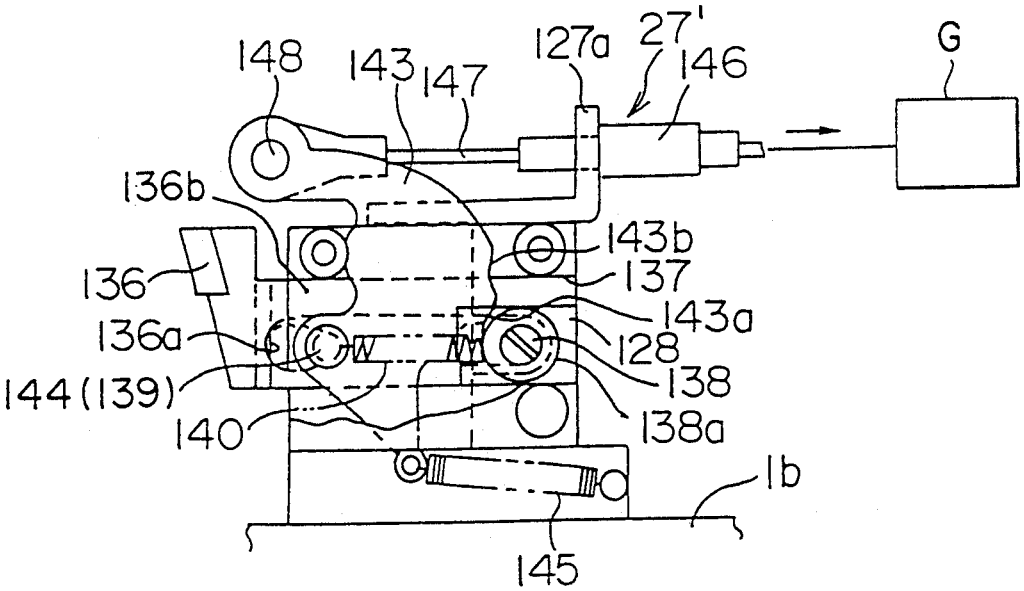
FIG. 22 is a front view of the same.
Figure 24:
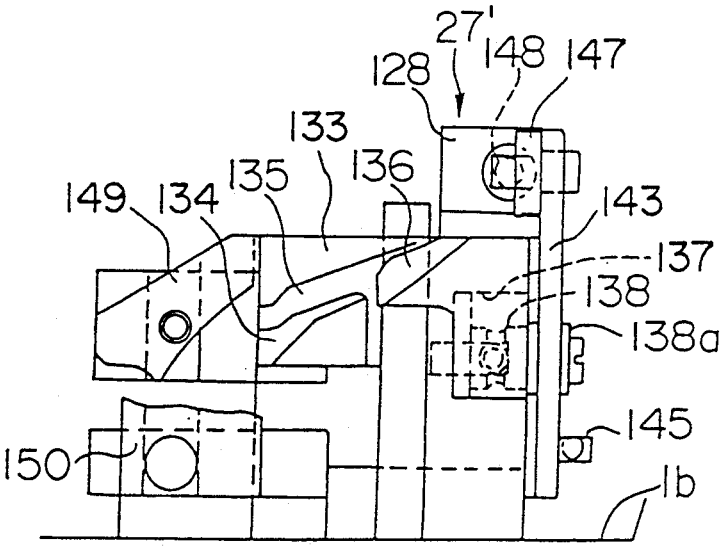
FIG. 24 is a side view of FIG. 22 as viewed from the left side.

In the vicinity of the above mentioned second guard cam 133 and the auxiliary stitching cam 134, a guide groove 137 is formed in the radial direction of the knitting machine cylinder device 2 in the holding frame 28 as shown in FIGS. 22 and 24. In this guide groove 137 is slidably fitted a support structure 136*b* of the above mentioned movable lowering cam 136. Also, at an outer end part of this movable lowering cam support structure 136*b*, a pin shaft 138 having a roller 138*a* is secured in a movement adjustable manner as shown in FIG. 21. In the vicinity of the aforementioned movable lowering cam support structure 136*b*, an anchor pin 139 is fixed to the holding frame 28 and passes through a slot 136*a* in the movable lowering cam support structure 136*b*. Between this anchor pin 139 and the pin shaft 138, a coil spring 140 is stretched so as to urge the movable lowering cam support structure 136*b* toward the axial center of the knitting machine cylinder 2.

Figure 23:
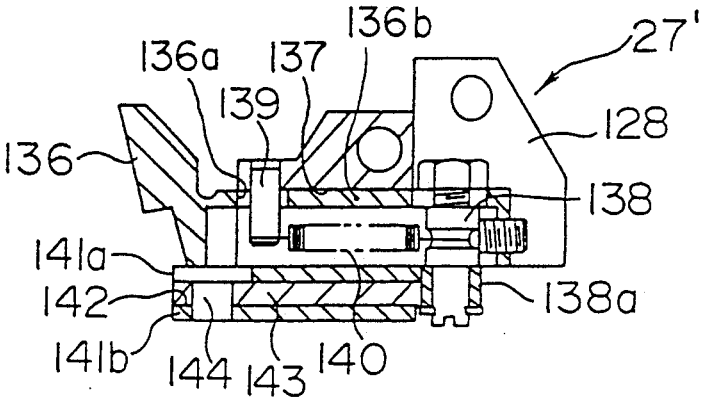
FIG. 23 is a sectional view of one part of FIG. 22.

Furthermore, as shown in FIG. 23, a pair of cover plates 141*a* and 141*b* are secured with a spacing gap 142 therebetween to the holding frame 28 in the vicinity of the roller 138*a*. In this spacing gap 142, a cam lever 143 is pivotally supported by a support shaft 144 between the two enclosing plates 141*a* and 141*b*. In addition, as shown in FIG. 22, at the outer edge of the cam lever 143 confronting the roller 138*a* is formed a first cam port 143*a* and a second cam part 143*b* are formed so as to selectively contact the roller 138*a*. The first cam part 143*a* and the second cam part 143*b* are so urged by the elastic force of a coil spring 145 as to selectively contact the roller 138*a*. Also as shown in FIG. 22, a cable holder 146 is fixed to a bracket 127*a* formed at the upper part of the holding frame 28. Through this cable holder 146 is passed an actuating cable 147, one end of which is connected to the above mentioned cam lever 143 by a pin 148. The other end of this actuating cable 147 is connected to a pile knitting control device G.

As shown in FIGS. 20 and 21, a stitch cam 149 and a cushion cam 150 are mounted on the holding frame 28 in the vicinity of the second guard cam 133 and the auxiliary stitch cam 134 of the knitting control cam unit 27' so as to form a D operation passageway 151. These stitching cam 149 and cushion cam 150, similarly as the stitching cam 36 and the cushion cam 37 of the preceding embodiment, are capable of moving up and down, and the stitch cam 149 is also capable of advancing and retracting in the radial direction.

In this manner, in the first knitting section, a knitting control cam unit 27' is installed, and, in the other knitting sections also, similar knitting control cam units 27' are similarly installed.

Therefore, when plain knitting is to be carried out with the use of the above described knitting control cam unit 27', the C operation passageway 135 is caused to be closed. That is, the movable lowering cam 136 is urged by the elastic force of the coil spring 140 toward the axial center of the knitting machine cylinder device 2 thereby to advance onto the movement path of the butts 6a of the knitting needles 6 and close the C operation passageway 135.

Next, when pile knitting is to be carried out, in FIGS. 20 and 24, the movable lowering cam 136 is retracted thereby to open the C operation passageway (pile passageway) 135.

More specifically, in response to a command from the pile knitting control device G, the actuating cable 147 is pulled in the arrow direction shown in FIGS. 21 and 22, whereby the cam lever 143 rotates about the support shaft 144 counter to the elastic force of the coil spring 145. Accordingly, the cam lever 143 undergoes a shift from its state wherein its first cam part 143a is contacting the roller 138a to the state wherein its second cam part 143b is contacting the roller 138a. Therefore, the movable lowering cam 136, under the elastic force of the coil spring 140, slides outward in the radial direction toward the axial center of the knitting machine cylinder device, thereby retracting and opening the C operation passageway (pile passageway) 135.

Figure 27:
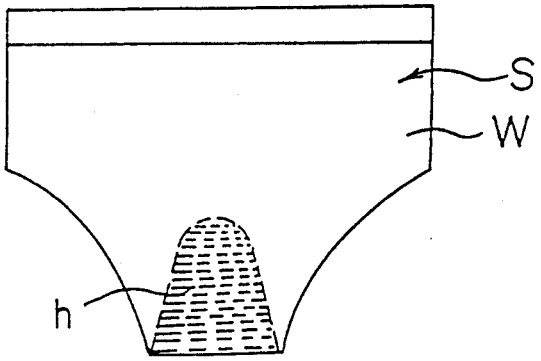
FIG. 27 is a view for describing a pile knit fabric of the crotch part of an apparel such as a pair of shorts.

As described above, by providing the movable lowering cam 136 so that it can slide freely in the radial direction of the knitting machine cylinder 2, a pile knitted fabric of any desired shape cam be knitted locally, for example, the crotch part h of knitwear such as a pair of shorts S as shown in FIG. 27. That is, with knitting needles 6 of middle gauge or fine gauge (14 NPI to 32 NPI) and without using a ground yarn sinker, a pile fabric can be knitted in a plain knit fabric part by using only a pile sinker 11' for fine gauge knitting.

A specific knitting example will now be described hereunder.

(a). The case of knitting a plain knit fabric part.

In the case where the waist part w of a pair of shorts s, for example, as shown in FIG. 27, is to be knitted a plain knit fabric part the movable lowering cam 136 of the knitting control cam unit 27' is placed beforehand and left in its advanced state on the plain knitting operation passageway as shown in FIG. 20.

Next, as the knitting machine cylinder 2 revolves when the circular knitting machine is operated, the jacks 5 and the knitting needles 6 revolve together therewith. The jacks 5 are then lifted by the lift cam 7, whereupon all knitting needles 6 are also lifted together therewith.

In this case, the patterning device 15 is not made operative, whereby the butts 6a of the knitting needles 6 are not selected by the needle selecting levers 17 of the patterning device 15.

Figure 25A:
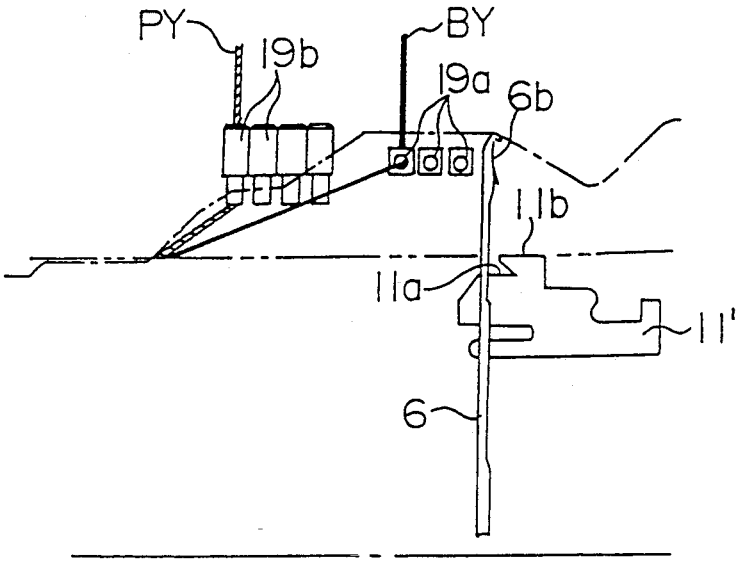
FIGS. 25*a* and 25*b* are a front view and a perspective view for a description of the operational action of a pile sinker.
Figure 25B:
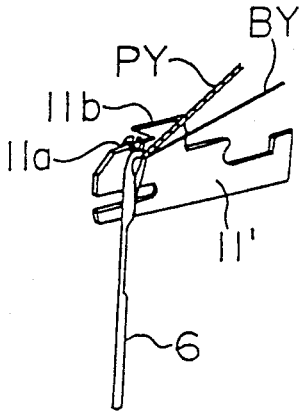

Then, the butts 6a of the knitting needles 6 are so guided as to pass through the A operation passageway 132 at the clearing level CL formed between the first guard cam 130 and the clearing cam 131 of the knitting control cam unit 27'. Then, as all butts 6a of the knitting needles 6 are passed from the A operation passageway 132 for plain knitting formed by the movable lowering cam 136 through the B operation passageway of the auxiliary stitch cam 134, the butts 6a of the knitting needles 6 are lowered before the second guard cam 133. By this action, as shown in FIGS. 25a and 25b, each knitting needle 6, together with ground yarn BY and pile yarn PY from the yarn feeding device 19, is arrested by a low land 11a' of the pile sinker 11', and, by the cooperative action of the hook 6b of the knitting needle 6 and the pile sinker 11', knitting of, for example, the waist part of a pair of shorts as a plain knitting part is carried out.

(b). Partially knitting a pile knit fabric part of optional outline in a plain knit fabric part.

In the case of partially knitting a pile knit fabric part of a desired outline in, for example, the crotch part h of a pair of shorts as shown in FIG. 27, the movable lowering cam 136 of the knitting control cam unit 27' is retracted and thus left beforehand as described hereinbefore.

Figure 26A:
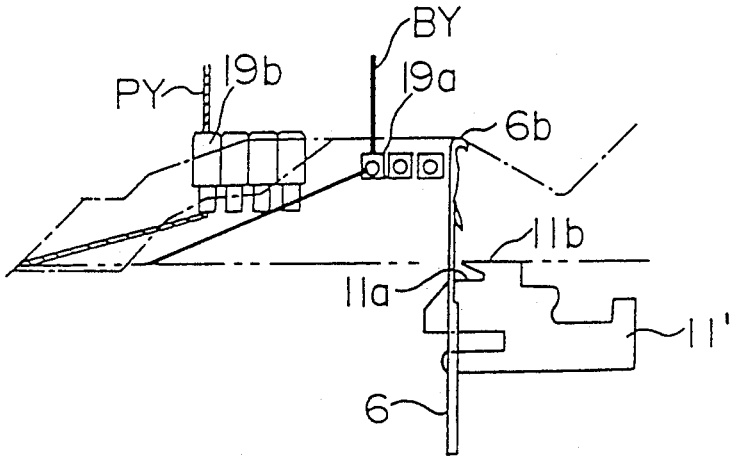
FIGS. 26*a* and 26*b* are a front view and a perspective view, respectively, for a description of another operational action of the pile sinker.
Figure 26B:
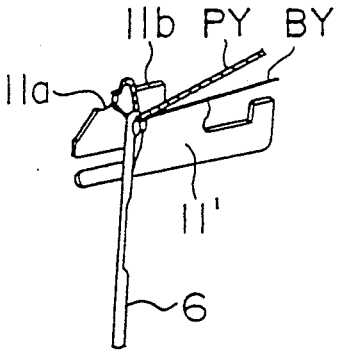

Next, as the knitting cylinder 2 revolves when the circular knitting machine is operated, the jacks 5 and the knitting needles 6 of the knitting cylinder 2 revolve together therewith. The butts 6a of the knitting needles 6 thereupon are selectively pushed by the needle selecting lever 17 of the patterning device 15 operating on the basis of a knitting program. Accordingly, the butts 6a of the selected knitting needles 6 are lifted by way of their jacks 5 by the lifting cam 7 and, passing by as they are the front face of the movable lowering cam 136, pass through the C operation passageway 135 to be pushed down by the stitching cam 149, then passing through the D operation passageway 151 between this stitching cam 149 and the cushion cam 150. By this action, as shown in FIGS. 26a and 26b, each knitting needle 6 causes pile yarn PY from the yarn feeding device 19 to be caught on a high land 11b of the pile sinker 11'. Then, by the cooperative action of the hooks 6b of the knitting needles 6 and the pile sinkers 11', a pile knit fabric part h of any desired outline is partially knitted in the plain knit fabric part of a pair of shorts s, for example.

On the other hand, the knitting needles 6 selected by the needle selecting lever 17 of the patterning device 15 pass horizontally by the tuck level TL, are pushed down by the auxiliary stitching cam 134, pass through the B operation passageway, and pass through the D operation passageway 151 between the stitching cam 149 and the cushion cam 150. By this action, as shown in FIGS. 25a and 25b, each knitting needle 6 causes ground yarn BY from the yarn feeding device 19 to be caught on the low land 11a of the pile sinker 11', and, by the cooperative action of the hook 6b of the knitting needle 6 and the pile sinker 11', the plain knit fabric part of a pair of shorts, for example, is knitted.

In this embodiment, a pile knit fabric can be partially knitted in a plain knit fabric part by using only a pile sinker for fine-gauge knitting without using a ground yarn sinker. Not only this, but since the organization is also simple, the assembly and adjustment are also facilitated. At the same time, the handling and operation are also simple, and further, since there are few constitutional parts, maintenance and inspection are also facilitated.

INDUSTRIAL APPLICABILITY

The circular knitting machine according to the present invention can be utilized for knitting knitted apparels such as body suits, brassieres, petticoats, and panties which have constricted parts, bulging parts around the entire periphery, and local partially bulging parts.

We claim:

1. A circular knitting machine for forming an article at a desired density, said knitting machine comprising
   (i) a machine frame,
   (ii) knitting cylinder means mounted in a freely revolvable manner on the frame, wherein the knitting cylinder means revolves on the frame in a revolving direction;
   (iii) a plurality of knitting sections disposed around said knitting cylinder means, each of said knitting sections comprising
      a) patterning means for controlling selection of needles,
      b) a knitting control cam unit, said knitting control cam unit having a side upstream relative to the revolving direction of the knitting cylinder means and a side downstream relative to said revolving direction, each knitting control cam unit comprising a first guard cam on the upstream side thereof, a second guard cam on the downstream side thereof, first control cam means disposed below said first guard cam for forming an operation passageway for butts of the knitting needles, and second control cam means disposed below said second guard cam for forming an operation passageway for the butts of the knitting needles, and
      c) yarn feeding means disposed above each knitting control cam unit for feeding yarn to said needles for forming said article, said knitting machine further comprising stitch density adjusting means for adjusting the density at which stitches are formed in said article, said stitch density adjusting means comprising
   i) a stitch cam and a cushion cam in each knitting section, said cushion cam being disposed below said stitch cam in each knitting section,
   ii) moving means for moving the stitch cam of each knitting section toward and away from the knitting cylinder means between an operative position and an inoperative position,
   iii) first means provided in each knitting section for independently actuating up-and-down movement of the stitch cam and the cushion cam relative to the second guard cam of each knitting section such that the stitch cam and the cushion cam of each knitting section can be actuated independently of the stitch cam and the cushion cam of every other knitting section, allowing the density of stitches formed in the article of each knitting section to be independently adjusted, and
   iv) second means for actuating the stitch cams and the cushion cams together simultaneously in up-and-down movement relative to the second guard cam of each knitting section so as to adjust concurrently the density of stitches formed in the article by all of the knitting sections, said second means comprising operational means, including an actuator, for actuating the first means of all of the knitting sections in unison.

2. A circular knitting machine according to claim 1, wherein said first means for actuating the stitch cam and the cushion cam of each knitting section in an up-and-down movement comprises: a supporting structure supported on the machine frame at each of the knitting sections; a vertically movable member slidably supported on the supporting structure in an up-and-down direction and fixedly holding said cushion cam; a stitch slider slidably supported on the vertically moveable member in a direction radial of the knitting cylinder; and actuating means for vertical movement provided in each of the knitting sections causing vertical displacement of the vertically movable member.

3. A circular knitting machine according to claim 2, wherein the actuating means for vertical movement comprises: stitch density adjustment control means; an actuating cable actuated by the stitch density adjustment control means; and a mechanism for undergoing displacement in accordance with actuation of the actuating cable to lift and lower said vertically movable member.

4. A circular knitting machine according to claim 3, wherein said mechanism for lifting and lowering said vertically movable member comprises: a pushing lever pivotally supported for rotation in accordance with actuation by the actuating cable; a lever rotating in accordance with rotation of the pushing lever; and an actuation bar rotating in accordance with the rotation of the lever thereby acting on the vertically movable member and causing the same to rise and descend.

5. A circular knitting machine according to claim 2, wherein said moving means comprises: a pivoted cam lever having a first cam part and a second cam part, a pin fixed to said stitch slider; a spring for elastically pushing said stitch slider toward the knitting cylinder to selectively press said pin against either one of said first cam part and said second cam part; and stitch density adjustment control means coupled to the pivoted cam lever actuating the pivoted cam lever in rotational movement, wherein when the cam lever is rotated pressing said pin against the first cam part, the stitch slider is advanced towards the knitting cylinder placing the stitch cam in an operative position, and when the cam lever is rotated pressing said pin against the second cam part, the stitch slider is moved away from the knitting cylinder placing the stitch cam in an inoperative position.

6. A circular knitting machine according to claim 2, wherein said operational means comprises: an operational ring provided on the support structure and located above all knitting sections an actuator for imparting revolving movement to the ring, and a stitch density adjustment control device connected to said actuator for operating the actuator, said operational ring being coupled to the actuating means for vertical movement of all knitting sections so as to operate, responsive to the revolution thereof, the actuating means for vertical movement.

7. A circular knitting machine according to claim 6, wherein said actuating means for vertical movement has an actuation bar pivotally mounted in each knitting section for engagement of the revolving ring, and the actuation bar engages the vertically movable member and causes vertical movement as the actuation bar revolves with the revolving ring.

8. A circular knitting machine according to claim 1, further comprising: an auxiliary stitch cam provided below the second guard cam forming therebetween an operational passageway for the butts of the knitting needles; and a movable lowering cam provided on an upstream side of said auxiliary stitch cam, said movable lowering cam displaceable between an operative position, wherein the lowering cam projects toward the knitting cylinder means, and an inoperative position wherein the lowering cam is retracted therefrom, said movable lowering cam closing, in the operational position thereof, said operational passageway between the second guard cam and the auxiliary stitching cam thereby to enable the butts of the knitting needles to pass through an operational passageway below the auxiliary stitch cam, the movable lowering cam opening, in said inoperative position, said operational passageway between the second guard cam and the auxiliary stitch cam to permit the butts of the knitting needles to pass through said operational passageway and thereby to cause pile stitches to be formed.

9. A circular knitting machine according to claim 8, further comprising: a movable lowering cam support structure supporting said movable lowering cam and being elastically pressed toward the knitting cylinder means; a pin shaft projecting from said support structure; a pivotally supported cam lever having a first cam part and a second cam part for selectively contacting said pin shaft upon rotation; and pile knitting control means connected to said cam lever to actuate in rotation the same, said first and second cam parts being so formed as to respectively hold the movable lowering cam in said operation position and said inoperative position.

* * * * *